US008754826B2

(12) United States Patent
Ozone et al.

(10) Patent No.: US 8,754,826 B2
(45) Date of Patent: Jun. 17, 2014

(54) ANTENNA DEVICE AND RADIO COMMUNICATION APPARATUS

(75) Inventors: Toru Ozone, Tokyo (JP); Hideaki Shoji, Tokyo (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 268 days.

(21) Appl. No.: 13/038,582

(22) Filed: Mar. 2, 2011

(65) Prior Publication Data

US 2011/0254753 A1 Oct. 20, 2011

Related U.S. Application Data

(60) Provisional application No. 61/324,591, filed on Apr. 15, 2010.

(51) Int. Cl.
*H01Q 1/50* (2006.01)

(52) U.S. Cl.
USPC ..... 343/861

(58) Field of Classification Search
CPC ..... H04B 1/0458; H04B 1/18; H04B 1/48; H04B 1/406; H04B 1/44; H04B 1/0053; H04B 1/0057; H04B 1/006; H04B 1/0067; H04B 1/005; H03F 1/56; H03F 3/60; H03F 2200/111; H03F 2200/423; H03F 2200/222; H03F 2200/252; H03F 2200/255; H03F 2200/387; H03H 7/383; H03H 7/0115; H03H 7/1758; H03H 7/1766; H03H 7/38; H03H 7/465; H03H 7/0123; H03H 7/0153; H03H 7/12; H03H 7/40; H01Q 1/521; H01Q 7/005
USPC ..... 333/17.3, 24 R, 32, 167, 172, 175, 262; 455/120, 121, 123, 125, 275, 276.1, 455/277.1, 290
See application file for complete search history.

(56) References Cited

U.S. PATENT DOCUMENTS

| | | | | |
|---|---|---|---|---|
| 4,201,960 | A * | 5/1980 | Skutta et al. | 333/17.3 |
| 2007/0018758 | A1 * | 1/2007 | Fukuda et al. | 333/263 |

FOREIGN PATENT DOCUMENTS

| | | |
|---|---|---|
| JP | 2000-216716 | 8/2000 |
| JP | 2005-059121 | 3/2005 |
| JP | 2007-143031 | 6/2007 |
| JP | 2007-235635 | 9/2007 |
| JP | 2008-011329 | 1/2008 |

* cited by examiner

*Primary Examiner* — Hoang V Nguyen
*Assistant Examiner* — Patrick Holecek
(74) *Attorney, Agent, or Firm* — Oblon, Spivak, McClelland, Maier & Neustadt, L.L.P.

(57) ABSTRACT

An antenna device that includes an antenna having a single feed and a shunt circuit. The shunt circuit includes a first shunt matching circuit causing impedance, viewed from a main path connecting the antenna and a radio frequency circuit, to be substantially infinite with respect to all frequency ranges handled by the antenna, and a second shunt matching circuit providing a predetermined impedance characteristic with respect to a first subset of the frequency ranges handled by the antenna. Each of the first and second shunt matching circuits are selectively connected to the main path, and a selection controller of the antenna device controls selection of which of the first and second shunt matching circuits are connected to the main path.

6 Claims, 15 Drawing Sheets

FIG. 10

| MATCHING | COVERED FREQUENCY | Vc1 | Vc2 | SHb | SHc |
|---|---|---|---|---|---|
| MC33b (+MC21) | LB1 (824 TO 894) | HIGH | LOW | ON | OFF |
| MC33c (+MC21) | LB2 (880 TO 960) | LOW | HIGH | OFF | ON |

FIG. 11

| MATCHING | COVERED FREQUENCY | Vc1 | Vc2 | SR2b | SR2c |
|---|---|---|---|---|---|
| MC36b (+MC21) | HB1 (1710 TO 1755, 1850 TO 2170) | HIGH | LOW | ON | OFF |
| MC36c (+MC21) | HB2 (1710 TO 1880, 2500 TO 2690) | LOW | HIGH | OFF | ON |

FIG. 12

| BAND STATES | SWITCHING STATES | |
|---|---|---|
| | SHUNT SWITCH | SERIES SWITCH |
| LB1 | b (STATE 1) | b (STATE 1) OR c (STATE 2) |
| LB2 | c (STATE 2) | b (STATE 1) OR c (STATE 2) |
| HB1 | b (STATE 1) | b (STATE 1) |
| HB2 | b (STATE 1) | c (STATE 2) |

ANTENNA DEVICE AND RADIO COMMUNICATION APPARATUS

CROSS REFERENCE TO RELATED APPLICATION

This application claims the benefit of priority of Provisional Application Ser. No. 61/324,591, filed Apr. 15, 2010, the entire contents of which is incorporated herein by reference.

BACKGROUND OF THE INVENTION

1. Field of the Invention

The present invention relates to an antenna device and a radio communication apparatus that are capable of performing radio communication in multiple frequency ranges.

2. Description of the Related Art

The so-called "cellular system" uses frequency ranges of 800 MHz to 2 GHz for radio communication. In the cellular system, frequency ranges (hereinafter may be referred to as "bands") to be used are specified for each country or region. Thus, the radio communication apparatus designed for use in various countries and regions has to be equipped with antenna devices that are capable of handling all bands specified for each country or region.

One example of such antennas that are capable of handling multiple bands is a two-branch antenna. The two-branch antenna is constituted by one RF (radio frequency) port and two elements for a low frequency range (hereinafter may be referred to as a "low band") and a high frequency range (hereinafter may be referred to as a "high band"). An antenna device having the two-branch antenna achieves impedance matching for two bands, i.e., the low band and the high band, by using the two-branch antenna and an LC resonant circuit.

For example, Japanese Unexamined Patent Application Publication Nos. 2000-216716 and 2008-11329 describe technologies in which multiple antennas are assigned to respective multiple bands. That is, Japanese Unexamined Patent Application Publication Nos. 2000-216716 and 2008-11329 describe technologies about the so-called "antenna switching diversity" for which multiple antennae are provided and are used through switching. Thus, with the technologies, appropriate switching between the multiple antennas assigned to the respective bands allows the antenna device to handle all bands.

For example, Japanese Unexamined Patent Application Publication Nos. 2005-59121, 2007-235635, and 2007-143031 describe technologies for varying impedance by changing the antenna length or by using constants connected to multiple paths. As described in Japanese Unexamined Patent Application Publication Nos. 2005-59121, 2007-235635, and 2007-143031, when the antenna length is varied or impedance is varied using the constants connected to the paths, the antenna device can handle multiple bands by using a single antenna.

SUMMARY OF THE INVENTION

In the cellular system, in the future, more frequency ranges, for example, frequency ranges of 700 MHz and 2.6 GHz, are scheduled to be used in addition to the frequency range of 800 MHz to 2 GHz.

With the above-described antenna devices, however, it is difficult for small-size terminals to achieve impedance matching with respect to all bands including frequency ranges of 700 MHz, 800 MHz, 2 GHz, 2.6 GHz, and so on.

When the technology described in Japanese Unexamined Patent Application Publication No. 2000-216716 or 2008-11329 is applied to handle all the bands, antennas of the antenna device have to be physically spaced apart from each other by a certain distance in order to prevent deterioration of an antenna efficiency based on inter-element mutual coupling. However, when the antennas are physically spaced apart from each other, the size of the antenna device increases and the size of a radio communication apparatus equipped with the antenna device also increases. Conversely, when the physical distance between the antennas is reduced in order to prevent an increase in the size of the antenna device, the antenna efficiency based on inter-element mutual coupling decreases, particularly, the antenna efficiency in adjacent bands deteriorates significantly.

When the technology described in Japanese Unexamined Patent Application Publication No. 2000-216716 or 2008-11329 is applied, it is necessary for the antenna device to have a configuration in which an antenna that is not in use (i.e., an unselected antenna) is terminated with an appropriate constant so that an antenna characteristic of an antenna that is in use (i.e., an antenna selected through antenna diversity) is not affected. Accordingly, the actual antenna design has measures, such as setting an appropriate constant for either one or both of the antenna in use and the antenna that is not in use.

When the technology described in Japanese Unexamined Patent Application Publication No. 2005-59121 or 2007-235635 is applied, the antenna device can realize dual resonance but does not handle multiple bands over a wide frequency range including the aforementioned frequency ranges of 700 MHz, 800 MHz, 2 GHz, 2.6 GHz, and so on. In order to handle all bands having such a wide frequency range, a larger antenna is necessary, resulting in an increased size of the antenna device. In such a case, naturally, the size of a radio communication apparatus equipped with the antenna device also increases.

When the technology described in Japanese Unexamined Patent Application Publication No. 2007-143031 is applied, an antenna device can achieve matching with respect to only adjacent frequencies and does not handle frequency ranges that are apart from each other to some degree, for example, a low band and a high band. In particular, an antenna device having a single circuit, as described in Japanese Unexamined Patent Application Publication No. 2007-143031, does not handle all bands over a wide frequency range including the aforementioned frequency ranges of 700 MHz, 800 MHz, 2 GHz, 2.6 GHz, and so on.

Accordingly, it is desirable to provide an antenna device and a radio communication apparatus which makes it possible to easily set appropriate constants without using a large antenna and which makes it possible to achieve a high antenna efficiency and impedance matching for all multiple bands over a wide frequency range.

According to one exemplary embodiment, the present invention is directed to an antenna device that includes an antenna having a single feed and a shunt circuit. The shunt circuit includes a first shunt matching circuit causing impedance, viewed from a main path connecting the antenna and a radio frequency circuit, to be substantially infinite with respect to all frequency ranges handled by the antenna, and a second shunt matching circuit providing a predetermined impedance characteristic with respect to a first subset of the frequency ranges handled by the antenna.

Each of the first and second shunt matching circuits are selectively connected to the main path, and a selection controller of the antenna device controls selection of which of the first and second shunt matching circuits are connected to the main path.

The present invention provides an antenna device and a radio communication apparatus which make it possible to easily set appropriate constants without using a large antenna and which make it possible to achieve a high antenna efficiency and impedance matching for all multiple bands over a wide frequency range.

BRIEF DESCRIPTION OF THE DRAWINGS

FIG. 10 is a table in which high/low levels of two switching control signals supplied to the shunt switch, first and second switching shunt paths switched by the high/low levels, and the matching circuits and bands selected by the high/low levels are associated with each other;

FIG. 11 is a table in which high/low levels of two switching control signals supplied to the series switch, first and second switching shunt series switched by the high/low levels, and the matching circuits and bands selected by the high/low levels are associated with each other;

FIG. 12 is a table in which switched terminals in the shunt switch and the series switch are associated with each other with respect to the low band and the high band;

DESCRIPTION OF THE PREFERRED EMBODIMENTS

Embodiments of the present invention will be described below with reference to the accompanying drawings.

[Fifth Embodiment]

Figure 1:
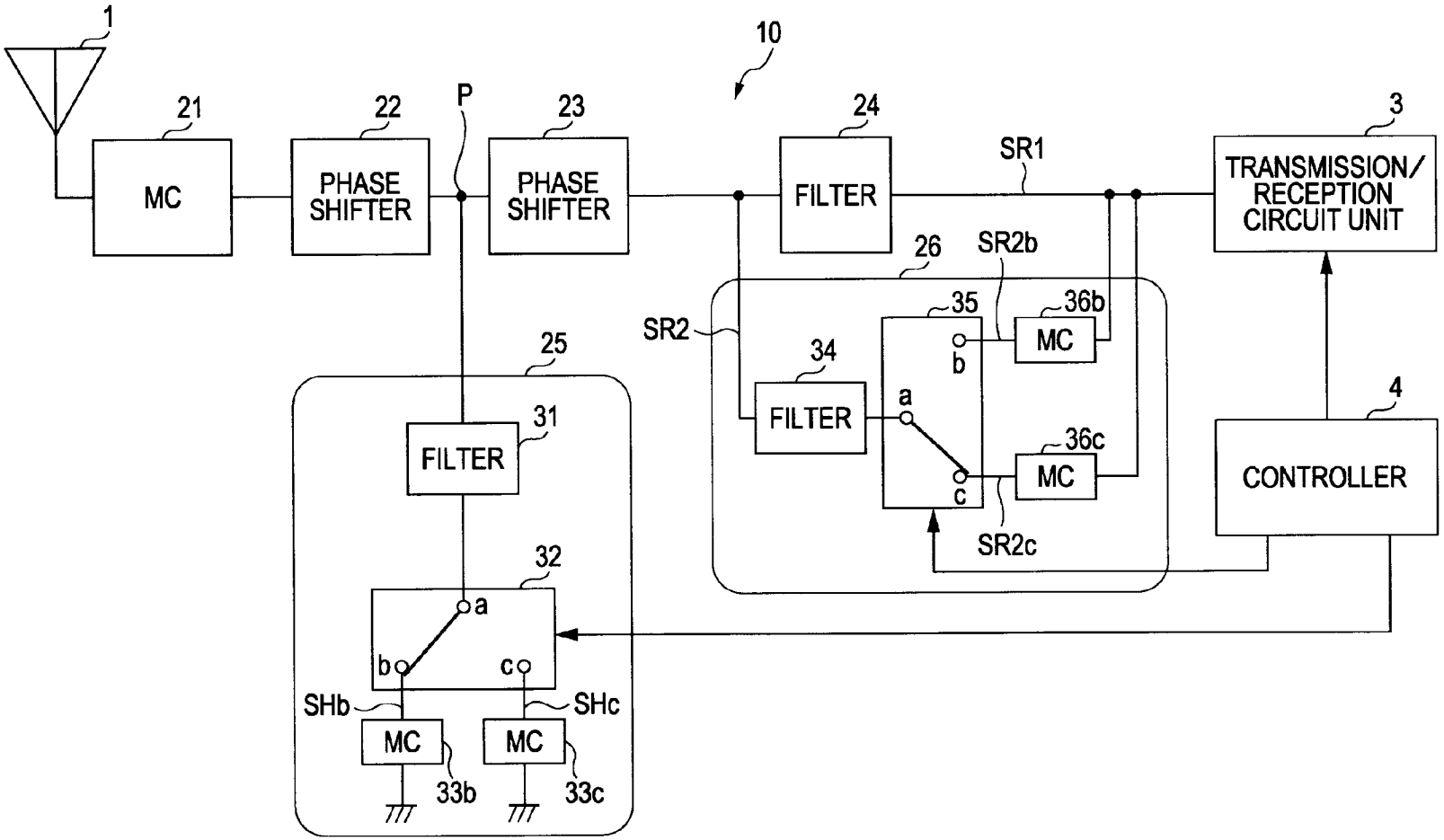
FIG. 1 is a block diagram showing a schematic configuration of an antenna device according to an embodiment of the present invention.

FIG. 1 shows a schematic configuration of an antenna device 10 according to an embodiment of the present invention, a transmission/reception circuit unit 3 for performing predetermined processing on a transmission/reception signal of the antenna device 10, and a controller 4 for controlling operations of the antenna device 10 and the transmission/reception circuit unit 3. The antenna device 10, the transmission/reception circuit unit 3, and the controller 4 can be incorporated into a radio communication apparatus (described below), which is one example.

In FIG. 1, an antenna 1 is a multi-band antenna having a single feed. That is, the antenna 1 is implemented by, for example, a multi-resonant antenna that is capable of handling multiple frequency ranges (bands), for example, a first band B1 and a second band B2 which are frequency ranges that are different from each other. Each of the first band B1 and the second band B2 can further be divided into multiple bands, details of which are described below.

The antenna 1 is connected to the transmission/reception circuit unit 3 via a main matching circuit (MC) 21, a first phase shifter 22, a second phase shifter 23, and a first series filter 24 which are connected in series in that order.

The main matching circuit 21 is used as a matching circuit that is based on both frequency ranges of the first and second bands B1 and B2. How a matching constant of the main matching circuit 21 is determined is described below.

The first phase shifter 22 and the second phase shifter 23 are provided so as to adjust (shift) the phase of a transmission/reception signal in accordance with the shape of a radio communication apparatus and so on equipped with the antenna device 10, the type of antenna, the length of signal line, and so on.

The first series filter 24 serves as a filter that allows passage of one of the frequency ranges of the first band B1 and the second band B2 and that blocks other frequency ranges. In the present embodiment, as one example, the first series filter 24 allows passage of the frequency range of the first band B1 and blocks other frequency ranges.

The transmission/reception circuit unit 3 includes an RF (radio frequency) circuit and a modulation/demodulation circuit. The transmission/reception circuit unit 3 divides each of the first band B1 and the second band B2 into multiple bands and also performs, for example, frequency conversion, modulation/demodulation, and encoding/decoding on signals in the bands.

In the antenna device 10 shown in FIG. 1, a predetermined connection point P located on a main path connecting the antenna 1 and the transmission/reception circuit unit 3 is connected to a shunt circuit 25. In the example of FIG. 1, the connection point P is located, for example, between the first phase shifter 22 and the second phase shifter 23.

The shunt circuit 25 includes a shunt filter 31, a shunt switch 32, a first shunt matching circuit (MC) 33*b*, and a second shunt matching circuit (MC) 33*c*.

The shunt filter 31 has an input end connected to the connection point P and has an output end connected to a common terminal a of the shunt switch 32. In the present embodiment, the shunt filter 31 serves as a filter that allows passage of one of the frequency ranges of the first band B1 and the second band B2 and that blocks other frequency ranges. In the present embodiment, for example, the shunt filter 31 allows passage of the frequency range of the first band B1 and blocks other frequency ranges, in the same manner as the first series filter 24.

The shunt switch 32 is the so-called "SPDT (single pole, dual throw) switch" having one common terminal a and two switched terminals b and c. One of the switched terminals b and c of the shunt switch 32 is selected by a switch operation control signal, supplied from the controller 4 (described below), so as to be electrically connected to the common terminal a. The switched terminal b of the shunt switch 32 is connected to the first shunt matching circuit 33*b* and the switched terminal c is connected to the second shunt matching circuit 33*c*. That is, the shunt switch 32 serves as a shunt-path switchover selection switch for selecting one of a first switching shunt path SHb for the first shunt matching circuit 33*b* and a second switching shunt path SHc for the second shunt matching circuit 33*c*.

The first shunt matching circuit 33*b* is connected between the switched terminal b of the shunt switch 32 and ground. The second shunt matching circuit 33*c* is connected between the switched terminal c of the shunt switch 32 and ground. The switched terminals b and c of the shunt switch 32 are switched over by the switch operation control signal from the controller 4, so that one of the first shunt matching circuit 33*b* and the second shunt matching circuit 33*c* is selected. How the matching constants of the first shunt matching circuit 33*b* and the second shunt matching circuit 33*c* are determined are described below.

In the antenna device 10 shown in FIG. 1, a series circuit 26 is also connected to the main path connecting the antenna 1 and the transmission/reception circuit unit 3. In the example of FIG. 1, the series circuit 26 is connected to the main path so as to be parallel to the first series filter 24. That is, the series circuit 26 is provided in parallel with the first series filter 24 and is connected between a connection point of the second phase shifter 23 and the first series filter 24 and a connection point of the first series filter 24 and the transmission/reception circuit unit 3.

In the present embodiment, the main path that runs through the first series filter 24 is referred to as a "first series path SR1" and a signal path that runs through the series circuit 26 is referred to as a "second series path SR2".

The series circuit 26 provided on the second series path SR2 includes a second series filter 34, a series switch 35, a first series matching circuit (MC) 36*b*, and a second series matching circuit (MC) 36*c*.

The second series filter 34 has an input end connected to the connection point of the second phase shifter 23 and the first series filter 24 and has an output end connected to a common terminal a of the series switch 35. In the present embodiment, the second series filter 34 serves as a filter that allows passage of one of the frequency ranges of the first band B1 and the second band B2 and that blocks other frequency ranges. In the present embodiment, as one example, the second series filter 34 allows passage of the frequency range of the second band B2 and blocks other frequency ranges.

The series switch 35 is the so-called "SPDT switch" having one common terminal a and two switched terminals b and c. One of the switched terminals b and c of the series switch 35 is selected by a switch operation control signal, supplied from the controller 4 (described below), so as to be electrically connected to the common terminal a.

The switched terminal b of the series switch 35 is connected to the connection point of the first series filter 24 and the transmission/reception circuit unit 3 via the first series matching circuit 36*b*. The switched terminal c of the series switch 35 is connected to the connection point of the first series filter 24 and the transmission/reception circuit unit 3 via the second series matching circuit 36*c*. The connection is switched to one of the switched terminals b and c of the series switch 35 in response to the switch operation control signal from the controller 4, so that a corresponding one of the first series matching circuit 36*b* and the second series matching circuit 36*c* is selectively connected to the output terminal of the second series filter 34. The series switch 35 serves as a series-path switchover selection switch for selecting one of a first switching series path SR2*b* for the first series matching circuit 36*b* and a second switching series path SR2*c* for the second series matching circuit 36*c* to switch the second series path SR2 to the selected switching series path.

As a result of such switching between the switched terminals b and c of the series switch 35, one of the first series matching circuit 36*b* and the second series matching circuit 36*c* is selected and is connected between the output end of the second series filter 34 and the transmission/reception circuit unit 3. How the matching constants of the first series matching circuit 36*b* and the second series matching circuit 36*c* are determined are described below.

The controller 4 executes various types of computation and control for the radio communication apparatus according to the present embodiment and also controls the transmission/reception circuit unit 3 in accordance with the usage state of the radio communication apparatus. In accordance with the usage state of the radio communication apparatus, the controller 4 generates the switch operation control signals for switching the shunt switch 32 and the series switch 35, that is, a path switchover selection control signal for selecting one of the first switching shunt path SHb and the second switching shunt path SHc and a path switchover selection control signal for selecting one of the first switching series path SR2*b* and the second switching series path SR2*c*.

Examples of the usage state of the radio communication apparatus include states that can cause changes in a frequency range used according to a place at which the radio communication apparatus is used, a radio system used, a reception level of a radio wave used, and impedance of the antenna device 10. Examples of the place at which the radio communication apparatus is used include a country and a region for which the corresponding frequency ranges used are pre-determined. Examples of the radio system used include a radio system that varies depending on the country or region, a radio communication system using a mobile phone network, a wireless LAN (local area network) communication system, a Bluetooth® communication system, and a GPS (global positioning system) communication system. One example of the reception level of the radio wave used is a reception level that varies depending on topography, weather, and a distance from a base station or the like. Examples of the states that can cause changes in the impedance of the antenna device 10 include a opening/closing state of the housing of a folding or sliding mobile phone or the like, a state in which the relationship between the head of a user and the antenna varies between when the mail/web function is used and when a phone call is made, and an on/off state of a diversity function.

[Configuration Example When Band is Limited]

Figure 2:
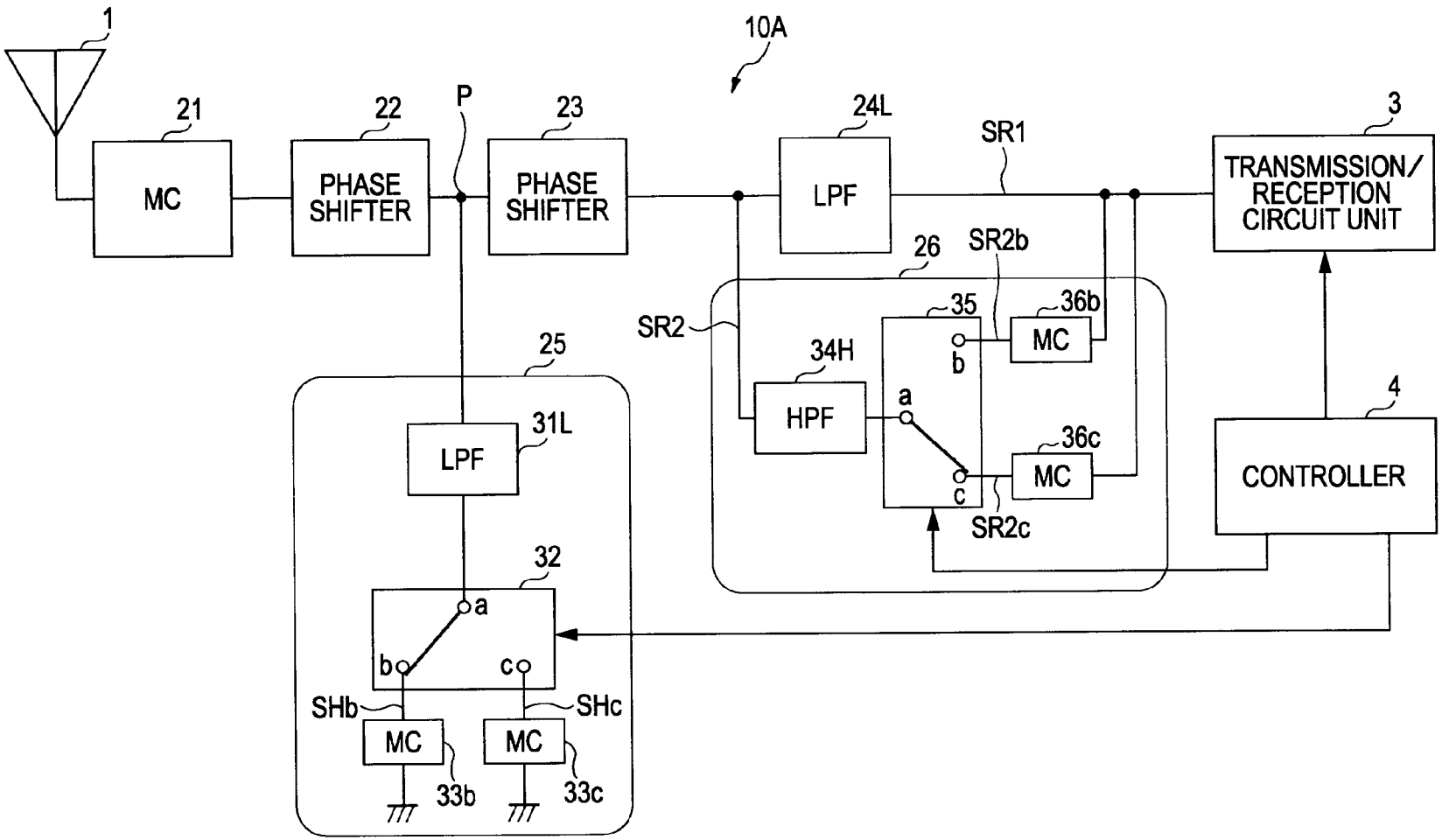
FIG. 2 is a block diagram showing a schematic configuration example of an antenna device according to a first embodiment of the present invention when a first band is a lower frequency range and a second band is a higher frequency range.

FIG. 2 shows one example of a schematic configuration of an antenna device 10A according to a first embodiment of the present invention. In the antenna device 10A, for example, the first band B1 is a lower frequency range and the second band B2 is a higher frequency range. In a description below, the first band B1, which is a lower frequency range, is particularly referred to as a "low band LB" and the second band B2, which is a higher frequency range, is particularly referred to as a "high band HB". The low band LB and the high band HB are frequency ranges in which the frequencies thereof are apart from each other by a factor of two. In the configuration shown in FIG. 2, elements that are substantially the same as those in FIG. 1 are denoted by the same reference numerals as those in FIG. 1.

The antenna device 10A shown in FIG. 2 has, as the first series filter 24 shown in FIG. 1, a series low-pass filter (LPF) 24L for allowing passage of the low band LB and blocking a higher frequency range than the low band LB. Similarly, the antenna device 10A has, as the shunt filter 31 shown in FIG. 1, a shunt low-pass filter (LPF) 31L for allowing passage of the low band LB and blocking a higher frequency range than the low band LB. The antenna device 10A also has, as the second series filter 34 shown in FIG. 1, a series high-pass filter (HPF) 34H for allowing passage of the high band HB and blocking a lower frequency range than the high band HB.

[Frequency Range and Matching Constant]

A description below will be given of frequency ranges used by the above-described antenna device according to the first embodiment and matching constants of the matching circuits. For simplicity of description, it is assumed that the phase adjustment values of the first phase shifter 22 and the second phase shifter 23 are pre-adjusted to optimum phase values.

[Specific Example of Frequency Ranges (Bands)]

Figure 3:
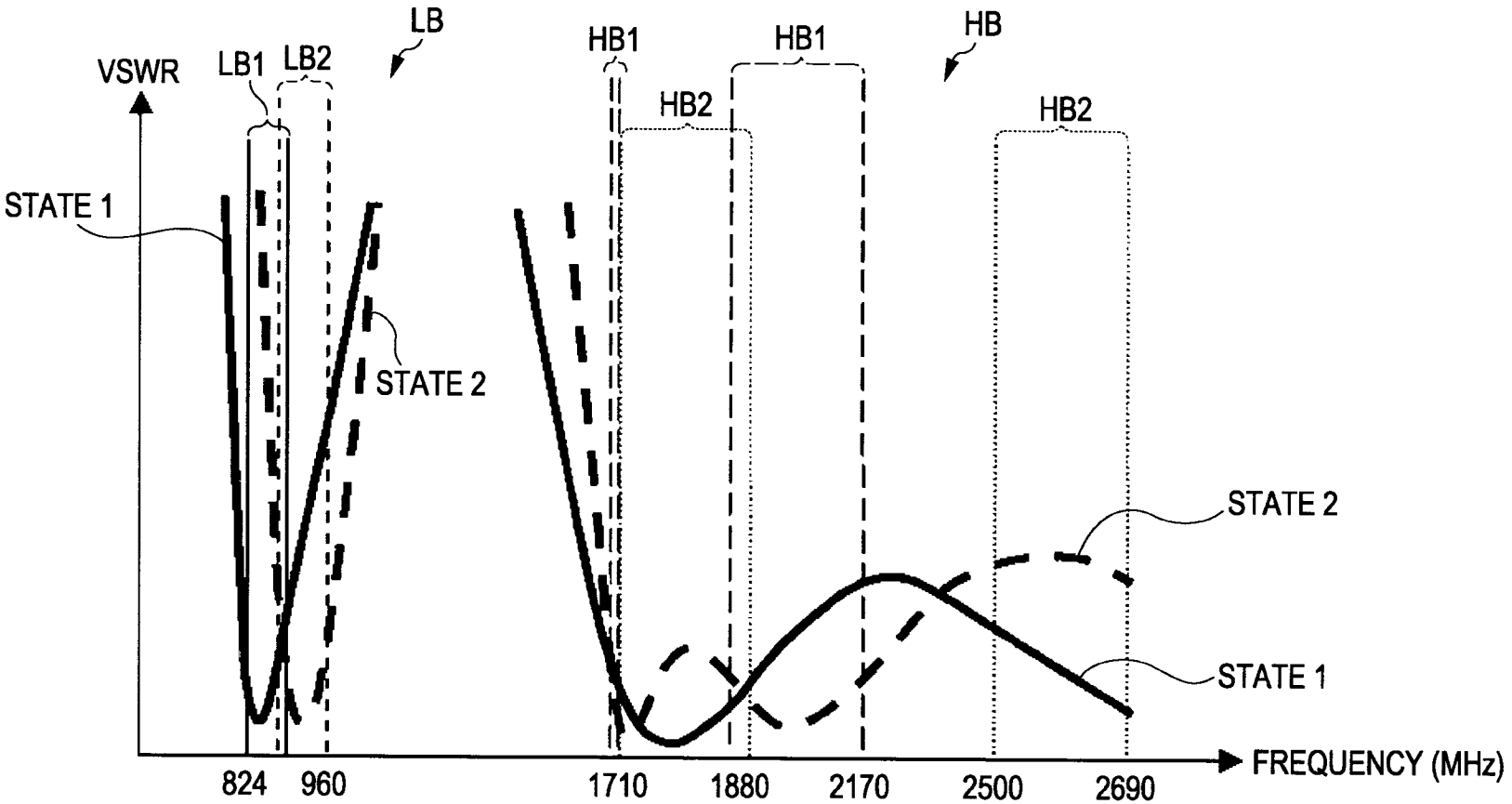
FIG. 3 is a graph showing a frequency versus a voltage standing wave ratio (VSWR), the graph being used to describe a low band and a high band in the embodiment of the present invention.

A description below is given of an example in which the first band B1 is limited to the low band LB and the second band B2 is limited to the high band HB, as in the case of the antenna device 10A shown in FIG. 2. As shown in FIG. 3, it is assumed that the low band LB can be divided into two bands, i.e., a first low band LB1 and a second low band LB2. On the other hand, it is assumed that the high band HB can be divided into a first high band HB1 and a second high band HB2 and each of the first high band HB1 and the second high band HB2 is further divided into two bands. More specifically, as shown in the example in FIG. 3, the first low band LB1 is a frequency range of 824 MHz to 894 MHz and the second low band LB2 is a frequency range of 880 MHz to 960 MHz, the first high band HB1 has a frequency range of 1710 MHz to 1755 MHz and a frequency range of 1850 MHz to 2170 MHz, and the second high band HB2 has a frequency range of 1710 MHz to 1880 MHz and a frequency range of 2500 MHz to 2690 MHz. The low band LB illustrated in the example of FIG. 3 refers to, of the frequency range of 824 MHz to 960 MHz, desired multiple radio bands that can be used according to the usage state of the radio communication apparatus. Similarly, the high band HB refers to, of the frequency range of 1710 MHz to 2690 MHz, desired multiple radio bands that can be used according to the usage state of the radio communication apparatus.

[Overview of Matching Constants of Matching Circuits]

In the antenna device 10A according to the present embodiment shown in FIG. 2, the shunt circuit 25 is provided as a matching circuit for the low band LB.

The first shunt matching circuit 33*b* in the shunt circuit 25 includes an inductor (L) and a capacitor (C). The first shunt matching circuit 33*b* serves as a termination circuit for causing the impedance of the shunt circuit 25, viewed from the connection point P of the main path, to be substantially infinite (open), with respect to both of the low band LB and the high band HB. That is, the first shunt matching circuit 33*b* is adjusted to have such a termination constant that the impedance becomes substantially open with respect to both of the low band LB and the high band HB when the first switching shunt path SHb for the first shunt matching circuit 33*b* is selected in the shunt circuit 25.

The main matching circuit 21 includes an inductor and a capacitor. The main matching circuit 21 is adjusted to have such a matching constant that impedance matching is achieved with respect to the first low band LB1 when the impedance of the shunt circuit 25 is open. That is, the matching constant of the main matching circuit 21 is adjusted so as to satisfy the first low band LB1 when the shunt switch 32 selects the first switching shunt path SHb for the first shunt matching circuit 33*b*.

The second shunt matching circuit 33*c* in the shunt circuit 25 includes an inductor and a capacitor. The second shunt matching circuit 33*c* is adjusted to have such a matching constant that impedance matching is achieved with respect to the second low band LB2 having higher frequencies than the first low band LB1 through mutual cooperation with the impedance matching performed by the main matching circuit 21. That is, the matching constant of the second shunt matching circuit 33*c* is adjusted such that, when the shunt switch 32 selects the second switching shunt path SHc for the second shunt matching circuit 33*c*, the impedance matching is achieved by the main matching circuit 21 and the second low band LB2 is satisfied.

On the other hand, in the antenna device 10A according to the present embodiment, the series circuit 26 is used as a matching circuit for the high band HB.

The matching constants of the first and second series matching circuits 36*b* and 36*c* in the series circuit 26 are adjusted such that all frequency ranges of the high band HB shown in FIG. 3 can be satisfied (or, are complemented) when the first and second series matching circuits 36*b* and 36*c* are in the respective impedance states.

In particular, in the present embodiment, the matching constant of the first series matching circuit 36*b* is adjusted such that, when the impedance of the shunt switch 32 is substantially open, the first high band HB1 is satisfied through mutual cooperation with the impedance matching performed by the main matching circuit 21.

In the present embodiment, the matching constant of the second series matching circuit 36*c* is adjusted such that, when the impedance of the shunt switch 32 is substantially open, the second high band HB2 is satisfied through mutual cooperation with the impedance matching performed by the main matching circuit 21.

[Matching Constant of Main Matching Circuit]

In the antenna device 10A according to the present embodiment, which of the first low band LB1 and the second low band LB2 is to be used is controlled by switching between the first shunt matching circuit 33*b* and the second shunt matching circuit 33*c* in the shunt circuit 25.

In other words, in the antenna device 10A according to the present embodiment, the switching between the first low band LB1 and the second low band LB2 is controlled by the inductors and the capacitors provided on the first and second switching shunt paths SHb and SHc.

Figure 4:
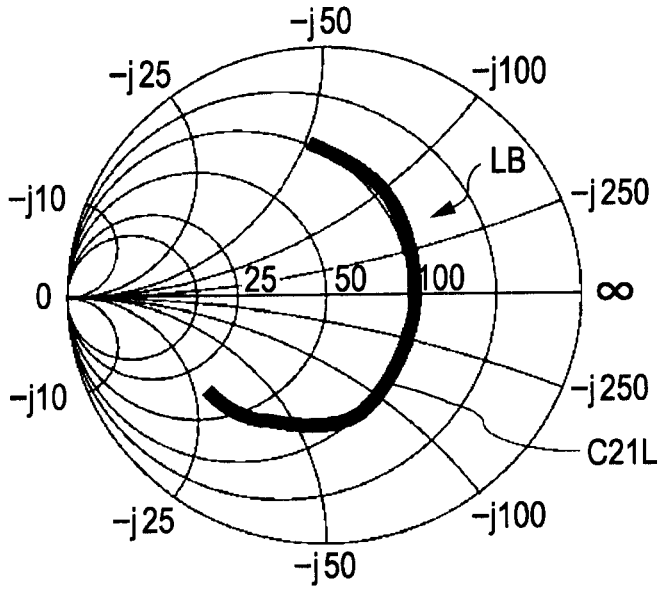
FIG. 4 is an admittance chart used to describe a matching constant of a main matching circuit with respect to the low band.

Thus, it is desirable to bring the impedance for the low band LB close to a constant conductance circle. Thus, the matching constant of the main matching circuit 21 is adjusted such that, in the low band LB, the impedance lies in the vicinity of the constant conductance circle, as indicated by a solid line C21L in an admittance chart in FIG. 4.

When the high band HB is used, the antenna device 10A according to the present embodiment performs controls so that the impedance of the shunt circuit 25 is substantially open.

Figure 5:
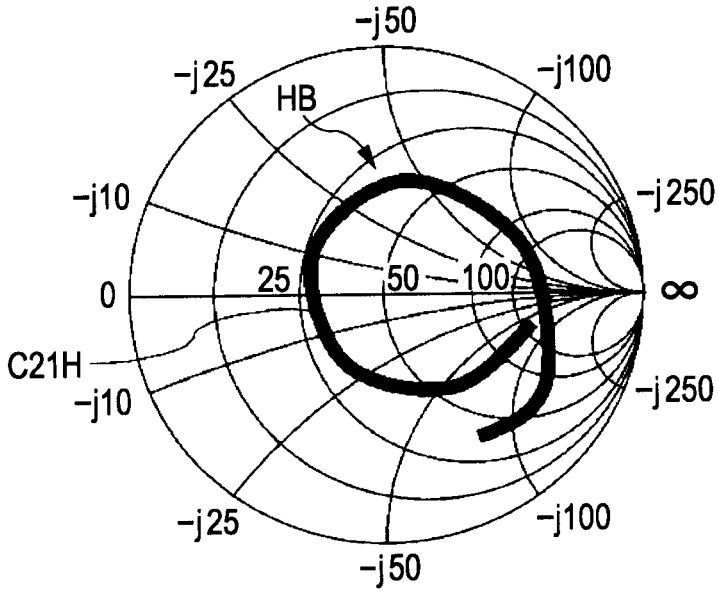
FIG. 5 is an impedance chart used to describe a matching constant of the main matching circuit with respect to the high band.

Thus, it is desirable to bring the impedance for the high band HB close to a constant resistance circle. Thus, the matching constant of the main matching circuit 21 is adjusted such that, in the high band HB, the impedance lies in the vicinity of a constant inductance circle, as indicated by a solid line C21H in an impedance chart in FIG. 5.

In order to satisfy two conditions for the low band LB and the high band HB, the main matching circuit 21 in the present embodiment is implemented by an LC parallel resonant circuit. The matching constant of the main matching circuit 21 is adjusted such that the LC parallel resonant circuit alone satisfies one frequency range of the low band LB (i.e., the first low band LB1).

[Matching Constants of First and Second Shunt Matching Circuits]

In the present embodiment, the first shunt matching circuit 33*b* is used as a termination circuit for causing the impedance of the shunt circuit 25 to be open when the high band HB is used.

That is, the first shunt matching circuit 33*b* has such a matching constant that, when the first switching shunt path SHb is selected, the impedance of the shunt circuit 25, viewed from the connection point P of the main path, is open with respect to both of the low band LB and the high band HB.

Figure 6:
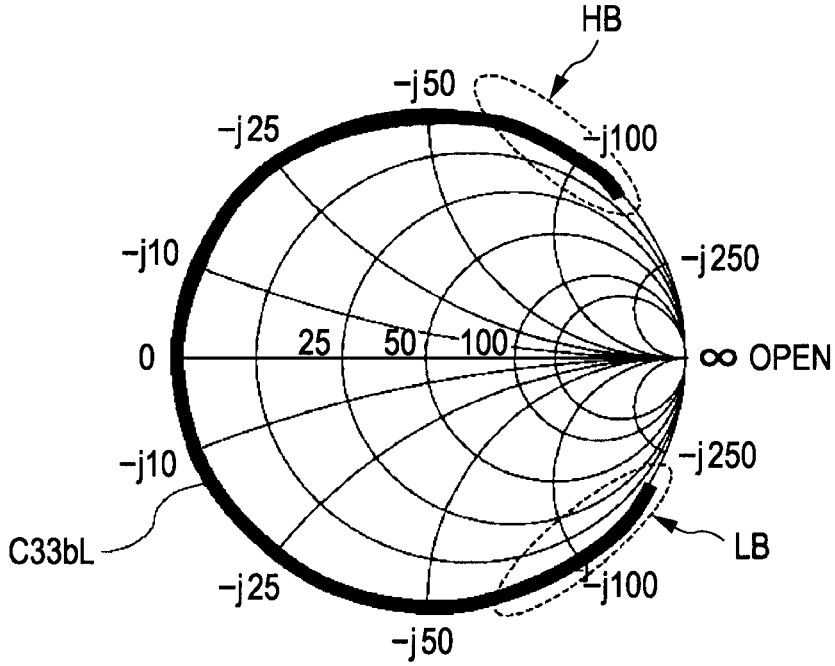
FIG. 6 is an impedance chart used to describe a matching constant of a first shunt matching circuit with respect to the high band.
Figure 7:
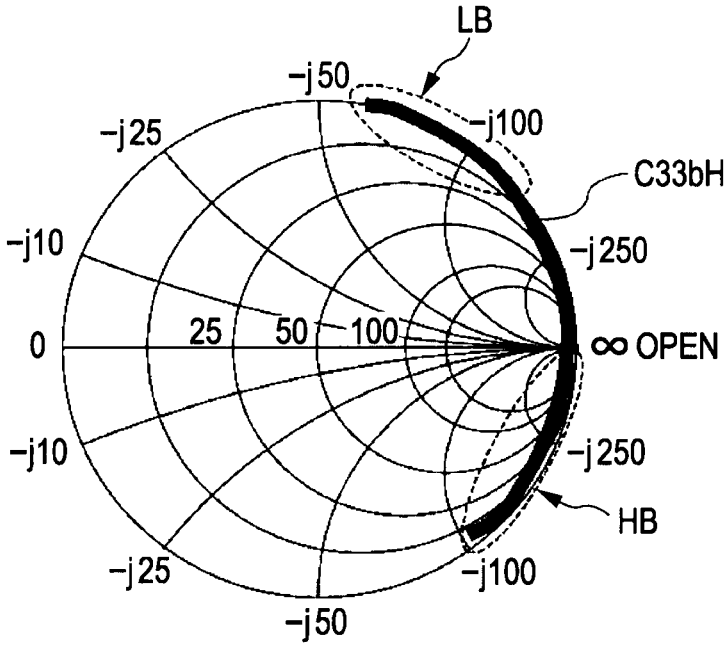
FIG. 7 is an impedance chart used to describe a matching constant of the first shunt matching circuit with respect to the low band.

Thus, the matching constant of the first shunt matching circuit 33*b* is adjusted so as to have an impedance (phase) characteristic, for example, as indicated by a solid line C33*b*L in an impedance chart in FIG. 6 or a solid line C33*b*H in an impedance chart in FIG. 7. FIGS. 6 and 7 show examples of impedance lines on which the impedance of the shunt circuit 25, viewed from the connection point P of the main path, is open with respect to both of the low band LB and the high band HB when the first switching shunt path SHb is selected.

The first shunt matching circuit 33*b* is constituted by, specifically, an LC element and a phase shifter (such as a transmission line).

In the present embodiment, the second shunt matching circuit 33*c* is used as a matching circuit for, particularly, the second low band LB2 in the low band LB.

As described above, the main matching circuit 21 has such a matching constant that the impedance for the low band LB lies in the vicinity of the constant conductance circle. With such a main matching circuit 21, when the second switching shunt path SHc is selected in the shunt circuit 25 and the path is connected to the second shunt matching circuit 33*c*, the impedance state changes and the frequency range also varies.

Thus, the second shunt matching circuit 33*c* has a matching constant adjusted such that, when the second switching shunt path SHc is selected in the shunt circuit 25, the frequency range changes to enable the use of the second low band LB2.

More specifically, the second shunt matching circuit 33*c* is configured so that, when the connection in the shunt switch 32 is switched to the switched terminal c, the impedance of the shunt circuit 25, viewed from the connection point P, and the impedance of the shunt filter 31 have an L (inductance) characteristic.

The second shunt matching circuit 33*c* is implemented by an LC element. Although the second shunt matching circuit 33*c* is an L-characteristic matching circuit in the present embodiment, it may be a C (capacitance) characteristic matching circuit, depending on, for example, the characteristic of the main matching circuit 21.

Figure 8:
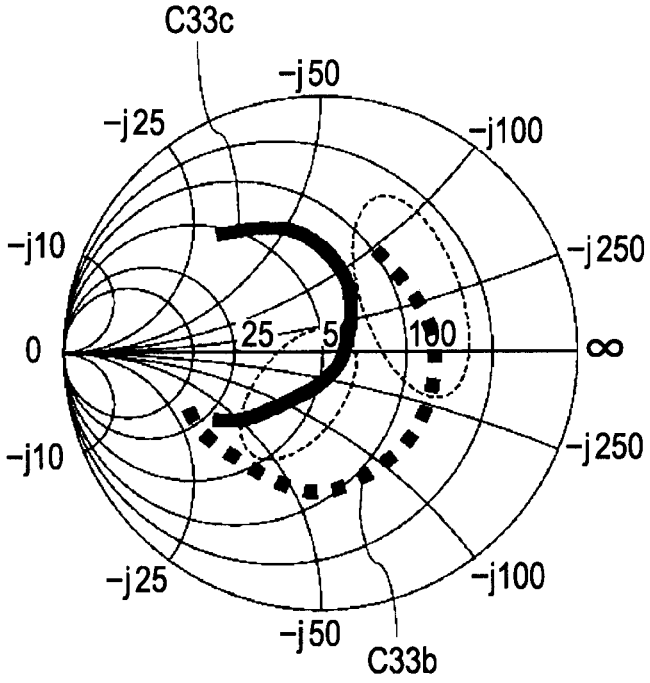
FIG. 8 is an admittance chart used to describe a change in an impedance characteristic, viewed from a connection point, when a first switching shunt path is selected in a shunt circuit and when a second switching shunt path is selected.

FIG. 8 illustrates changes in the antenna characteristic (impedance characteristic) of the antenna 1, the main matching circuit 21, and the shunt circuit 25, viewed from the transmission/reception circuit unit 3, when the first switching shunt path SHb is selected and when the second switching shunt path SHc is selected in the shunt circuit 25.

As shown in FIG. 8, the antenna characteristic (the impedance characteristic) of the antenna 1, the main matching circuit 21, and the shunt circuit 25, viewed from the transmission/reception circuit unit 3, changes when the first switching shunt path SHb that has been selected is switched over to the second switching shunt path SHc. As a result, the frequency range also changes.

[Matching Constants of First and Second Series Matching Circuits]

In the present embodiment, the first and second series matching circuits 36*b* and 36*c* are used as matching circuits for the high band HB.

As described above, the main matching circuit 21 has such a matching circuit that the impedance for the high band HB lies in the vicinity of the constant resistance circle.

With such a main matching circuit 21, when the first switching shunt path SHb is selected in the shunt circuit 25 to cause the impedance of the shunt circuit 25 to be open, a signal in the high band HB passes through the second series path SR2.

In this state, when one of the first switching series path SR2*b* and the second switching series path SR2*c* of the second series path SR2 is selected, the matching circuit provided for the selected switching series path determines an impedance state, so that the frequency range is also determined.

Thus, in the present embodiment, the first and second series matching circuits 36*b* and 36*c* provided for the corresponding first and second switching series paths SR2*b* and SR2*c* are adjusted to have such matching constants that impedance matching is achieved with respect to desired bands of the first and second high bands HB1 and HB2, by mutually cooperating with the impedance matching performed by the main matching circuit 21.

More specifically, the matching constant of the first series matching circuit 36*b* is adjusted so as to satisfy the first high band HB1. The matching constant of the second series matching circuit 36*c* is adjusted so as to satisfy the second high band HB2. The first and second series matching circuits 36*b* and 36*c* are implemented by LC elements.

[Advantage Obtained by Shunt Circuit and Series Circuit]

Since the antenna device 10A according to the present embodiment has the shunt circuit 25 having matching constants adjusted as described above, it is possible to achieve two impedance states with respect to the low band LB. The antenna device 10A according to the present embodiment is capable of achieving a favorable impedance characteristic in the entire low band LB by switching between the impedance states. Since the antenna device 10A according to the present embodiment has the shunt circuit 25, it is possible to achieve low loss compared to, for example, a case in which the circuitry is implemented by only a series path as in the related art.

In addition, in the antenna device 10A according to the present embodiment, since the first shunt matching circuit 33*b* also serves as a termination circuit when the high band HB is used, it is possible to reduce the circuit scale and it is also possible to eliminate a necessity for providing a termination circuit for the high band HB, unlike the case in the related. That is, according to the present embodiment, when the first shunt matching circuit 33*b* is selected, the shunt circuit 25 appears to be disconnected (to be absent) when viewed from the connection point P. Thus, when the high band HB is used, an influence of the low band LB can be substantially eliminated. Similarly, when the first shunt matching circuit 33*b* is selected, the impedance of the shunt circuit 25, viewed from the connection point P, appears to be open. Thus, with respect to the first low band LB1, the matching adjustment can be achieved by only the main matching circuit 21.

Additionally, since the first shunt matching circuit 33*b* serves as a termination circuit for the high band HB, the series circuit 26 can variably control the frequency range in the high band HB by only adjusting the matching constants of the first and second series matching circuits 36*b* and 36*c*.

For example, if the first shunt matching circuit 33*b* is not provided, an influence of the shunt circuit 25 with respect to the high band HB appears to the connection point P. This makes it difficult to achieve impedance matching. For example, if another terminal for termination for the high band HB is provided, the shunt switch generally has to be an SP3T (single pole, three throw) switch. Consequently, the circuit scale increases and the cost also increases. In contrast, when the high band HB is used in the antenna device 10A according to the present embodiment, the shunt circuit 25 appears to be disconnected when viewed from the connection point P. Consequently, it is easy to achieve impedance matching. According to the antenna device 10A of the present embodiment, it is possible to reduce the circuit scale and to suppress an increase in the cost without providing, for example, another terminal for termination for the high band HB.

According to the antenna device 10A of the present embodiment, the series circuit 26 can also achieve two impedance states by using the first series matching circuit 36*b* and the second series matching circuit 36*c*. In addition, the antenna device 10A of the present embodiment can achieve a favorable impedance characteristic in the entire high band HB by switching between the impedance states.

[Specific Example of Switches and Example of Band-and-Switch Control Performed by Controller]

Figure 9:
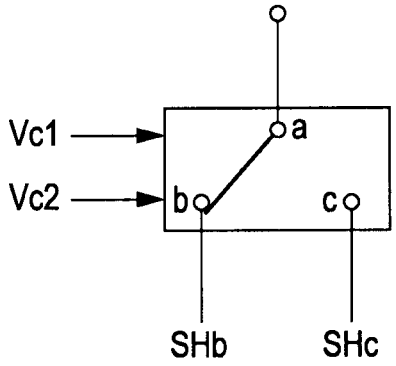
FIG. 9 shows an example of a specific structure of a shunt switch and a series switch.

FIG. 9 illustrates an example of a specific structure of the shunt switch 32 and the series switch 35. That is, the shunt switch 32 and the series switch 35 have, for example, a structure, as shown in FIG. 9, in which a combination of high and low levels of two switching control signals Vc1 and Vc2 achieves switching of a single switch element.

FIG. 10 shows a table in which the high/low levels of two switching control signals Vc1 and Vc2 supplied to the shunt switch 32, the first and second switching shunt paths SHb and SHc selected when the switched terminals b and c are selected according to the high/low levels, and the matching circuits and bands selected by the high/low levels are associated with each other. FIG. 11 shows a table in which the high/low levels of two switching control signals Vc1 and Vc2 supplied to the series switch 35, the first and second switching shunt paths SR2*b* and SR2*c* selected when the switched terminals b and c are selected according to the high/low level, and the matching circuits and bands selected by the high/low levels are associated with each other. FIG. 12 is a table in which the switched terminals b and c in the shunt switch 32 and the series switch 35 are associated with each other with respect to the low band LB and the high band HB.

In the antenna device 10A of the present embodiment, the controller 4 controls the switching of the shunt switch 32 and the series switch 35, as shown in FIGS. 9 to 12, to thereby achieve impedance matching when the low band LB and the high band HB are used.

One example of band selection control based on switch operation control executed by the controller 4, the control including control for the transmission/reception circuit unit 3, will be described below with reference to FIGS. 9 to 12.

First, an example of switch operation control and transmission/reception-circuit-unit control executed by the controller 4 in a case in which radio communication using the low band LB is performed will be described in conjunction with an example of operations of the receiving system.

The controller 4 has a channel table for determining a reception frequency (a reception band). The channel table contains switch control information for performing switch operation control, as shown in FIGS. 10 to 12. In accordance with the above-described usage state of the radio communication apparatus, the controller 4 selects an optimum frequency at each point in time.

For example, when the reception frequency is to be the first low band LB1, the controller 4 sends, to the transmission/reception circuit unit 3, a control signal indicating that the first low band LB1 is to be used as the reception frequency.

Upon receiving the control signal, the transmission/reception circuit unit 3 operates as a transmission/reception circuit for the frequency range of the first low band LB1. That is, in the transmission/reception circuit unit 3 in this case, the RF circuit and the modulation/demodulation circuit change their operations so as to correspond to the frequency range of the first low band LB1 and also change the operations so as to perform frequency conversion, modulation/demodulation, and encoding/decoding, and so on corresponding to a signal transmitted/received using the first low band LB1.

At the same time, the controller 4 reads the switch control information corresponding to the reception frequency of the first low band LB1 from the channel table and sends, to the shunt switch 32 and the series switch 35, high/low-level switching control signals Vc1 and Vc2 corresponding to the switch control information.

That is, when the first low band LB1 is used, the controller 4 sends a high-level switching control signal Vc1 and a low-level switching control signal Vc2 to the shunt switch 32, as shown in FIG. 10. Consequently, the switched terminal b in the shunt switch 32 is turned on, so that the first switching shunt path SHb is selected.

As described above, the first shunt matching circuit 33*b* provided for the first switching shunt path SHb has such a matching constant that the impedance of the shunt circuit 25, viewed from the connection point P, is open with respect to both of the high band HB and the low band LB. Thus, when the first switching shunt path SHb is selected by the shunt switch 32, the shunt circuit 25 appears to be disconnected when viewed from the connection point P.

Thus, when a signal in the first low band LB1 is received by the antenna device 10A, the signal is input to the transmission/reception circuit unit 3 through the series low-pass filter 24L on the first series path SR1 without going through the shunt circuit 25.

Thus, when the antenna device 10A receives a signal in the first low band LB1, the main matching circuit 21 achieves optimum impedance matching in the first low band LB1, as described above, thus making it possible to perform favorable communication.

When the reception frequency is to be the second low band LB2, the controller 4 sends, to the transmission/reception circuit unit 3, a control signal indicating that the second low band LB2 is to be used as the reception frequency.

Upon receiving the control signal, the transmission/reception circuit unit 3 operates as a transmission/reception circuit for the frequency range of the second low band LB2. That is, in the transmission/reception circuit unit 3 in this case, the RF circuit and the modulation/demodulation circuit change their operations so as to correspond to the frequency range of the second low band LB2 and also change the operations so as to perform frequency conversion, modulation/demodulation, and encoding/decoding, and so on corresponding to a signal transmitted/received using the second low band LB2.

At the same time, the controller 4 reads the switch control information corresponding to the reception frequency of the second low band LB2 from the channel table and sends, to the shunt switch 32 and the series switch 35, high/low-level switching control signals Vc1 and Vc2 corresponding to the switch control information.

That is, when the second low band LB2 is used, the controller 4 sends a low-level switching control signal Vc1 and a high-level switching control signal Vc2 to the shunt switch 32, as shown in FIG. 10. Consequently, the switched terminal b in the shunt switch 32 is turned off, so that the second switching shunt path SHc is selected.

As described above, the second shunt matching circuit 33*c* provided for the second switching shunt path SHc has such a matching constant that impedance matching is achieved with respect to the second low band LB2 through mutual cooperation with the impedance matching performed by the main matching circuit 21.

Thus, when the antenna device 10A receives a signal in the second low band LB2, the main matching circuit 21 and the second shunt matching circuit 33*c* for the second switching shunt path SHc achieve optimum impedance matching, as described above. Consequently, it is possible to perform favorable communication.

As described above, the antenna device 10A according to the present embodiment has the series high-pass filter 34H on the second series path SR2. Thus, during reception of a signal in the first low band LB1 or the second low band LB2, the reception signal in the low band LB is blocked by the series high-pass filter 34H. Thus, the first series matching circuit 36*b* and the second series matching circuit 36*c* provided in the series circuit 26 have a significantly small influence on the impedance characteristic of the low band LB. Thus, according to the present embodiment, it is sufficient to connect either high-level switching control signals Vc1 and Vc2 or low-level switching control switching control signals Vc1 and Vc2 to the series switch 35 during reception of a signal in the first low band LB1 or the second low band LB2, and thus the switch control information in the channel table is also set as such.

Since the switch operation control and the transmission/reception control performed when the antenna device 10A according to the present embodiment performs radio transmission using the low band LB are analogous to those of the receiving system, descriptions of those of the transmitting system are not given hereinafter.

Next, an example of switch operation control and transmission/reception-circuit-unit control executed by the controller 4 in a case in which radio communication using the high band HB is performed will be described in conjunction with an example of operations of the receiving system.

For example, when the reception frequency is to be the first high band HB1, the controller 4 sends, to the transmission/reception circuit unit 3, a control signal indicating that the first high band HB1 is to be used as the reception frequency.

Upon receiving the control signal, the transmission/reception circuit unit 3 operates as a transmission/reception circuit for the frequency range of the first high band HB1. That is, in the transmission/reception circuit unit 3 in this case, the RF circuit and the modulation/demodulation circuit change their operations so as to correspond to the frequency range of the first high band HB1 and also change the operations so as to perform frequency conversion, modulation/demodulation, and encoding/decoding, and so on corresponding to a signal transmitted/received using the first high band HB1.

At the same time, the controller 4 reads, from the channel table, the switch control information corresponding to the reception frequency of the first high band HB1 and sends, to the shunt switch 32 and the series switch 35, high/low-level switching control signals Vc1 and Vc2 corresponding to the switch control information.

That is, when the first high band HB1 is used, the controller 4 sends a high-level switching control signal Vc1 and a low-level switching control signal Vc2 to the shunt switch 32 and sends a high-level switching control signal Vc1 and a low-level switching control signal Vc2 to the series switch 35, as shown in FIGS. 10 and 11. Consequently, the switched terminal b in the shunt switch 32 is turned on to select the first switching shunt path SHb and the switched terminal b in the series switch 35 is turned on to select the first switching series path SR2*b*.

As described above, the first shunt matching circuit 33*b* provided for the first switching shunt path SHb has such a matching constant that the impedance of the shunt circuit 25, viewed from the connection point P, is open with respect to both of the high band HB and the low band LB. Thus, when the shunt switch 32 selects the first switching shunt path SHb, the shunt circuit 25 appears to be disconnected when viewed from the connection point P.

Thus, when a signal in the first high band HB1 is received by the antenna device 10, the signal is input to the transmission/reception circuit unit 3 through the series high-pass filter 34H on the second series path SR2 and further the first switching series path SR2*b* without going through the shunt circuit 25.

As described above, the first series matching circuit 36*b* provided for the first switching series path SR2*b* has such a matching constant that impedance matching is achieved with respect to the first high band HB1 through mutual cooperation with the impedance matching performed by the main matching circuit 21.

Thus, when the antenna device 10A receives a signal in the first high band HB1, the main matching circuit 21 and the first series matching circuit 36*b* for the first switching series path SR2*b* achieve optimum impedance matching, as described above. Consequently, it is possible to perform favorable communication.

When the reception frequency is to be the second high band HB2, the controller 4 sends, to the transmission/reception circuit unit 3, a control signal indicating that the second high band HB2 is to be used as the reception frequency.

Upon receiving the control signal, the transmission/reception circuit unit 3 operates as a transmission/reception circuit for the frequency range of the second high band HB2. That is, in the transmission/reception circuit unit 3 in this case, the RF circuit and the modulation/demodulation circuit change their operations so as to correspond to the frequency range of the second high band HB2 and also change the operations so as to perform frequency conversion, modulation/demodulation, and encoding/decoding, and so on corresponding to a signal transmitted/received using the second high band HB2.

At the same time, the controller 4 reads the switch control information corresponding to the reception frequency of the second high band HB2 from the channel table and sends, to the shunt switch 32 and the series switch 35, high/low-level switching control signals Vc1 and Vc2 corresponding to the switch control information.

That is, when the second high band HB2 is used, the controller 4 sends a high-level switching control signal Vc1 and a low-level switching control signal Vc2 to the shunt switch 32 and sends a low-level switching control signal Vc1 and a high-level switching control signal Vc2 to the series switch 35, as shown in FIGS. 10 and 11. Consequently, the switched terminal b in the shunt switch 32 is turned on to select the first switching shunt path SHb and the switched terminal c in the series switch 35 is turned on to select the second switching series path SR2*c*.

Thus, when the second high band HB2 is used, the shunt circuit 25 also appears to be disconnected when viewed from the connection point P, as in the case in which the first high band HB1 is used.

Thus, when a signal in the second high band HB2 is received by the antenna device 10, the signal is input to the transmission/reception circuit unit 3 through the series high-pass filter 34H on the second series path SR2 and further the second switching series path SR2*c* without going through the shunt circuit 25.

As described above, the second series matching circuit 36*c* provided for the second switching series path SR2*c* has such a matching constant that impedance matching is achieved with respect to the second high band HB2 through mutual cooperation with the impedance matching performed by the main matching circuit 21.

Thus, when the antenna device 10A receives a signal in the second high band HB2, the main matching circuit 21 and the second series matching circuit 36*c* for the second switching series path SR2*c* achieve optimum impedance matching, as described above. Consequently, it is possible to perform favorable communication.

As described above, the antenna device 10A according to the present embodiment has the series low-pass filter 24L on the first series path SR1. Thus, during reception of a signal in the first high band HB or the second high band HB2, the reception signal in the high band HB is blocked by the series low-pass filter 24L. During reception of the signal in the high band HB, the connection in the shunt circuit 25 is fixed to the first switching shunt path SHb and the shunt circuit 25 appears to be disconnected when viewed from the connection point P. Thus, the shunt switch 32 and the shunt matching circuits 33*b* and 33*c* in the shunt circuit 25 have almost no influence on the impedance. In other words, according to the present embodiment, with respect to the high band HB, design can be performed considering only the matching for the series paths without considering the influence of the shunt circuit 25, thus making it possible to simplify the design.

Since the switch operation control and the transmission/reception control performed when the antenna device 10A according to the present embodiment performs radio transmission using the high band HB are analogous to those of the receiving system described above, descriptions of those of the transmitting system are not given hereinafter.

[Second Embodiment]

Figure 13:
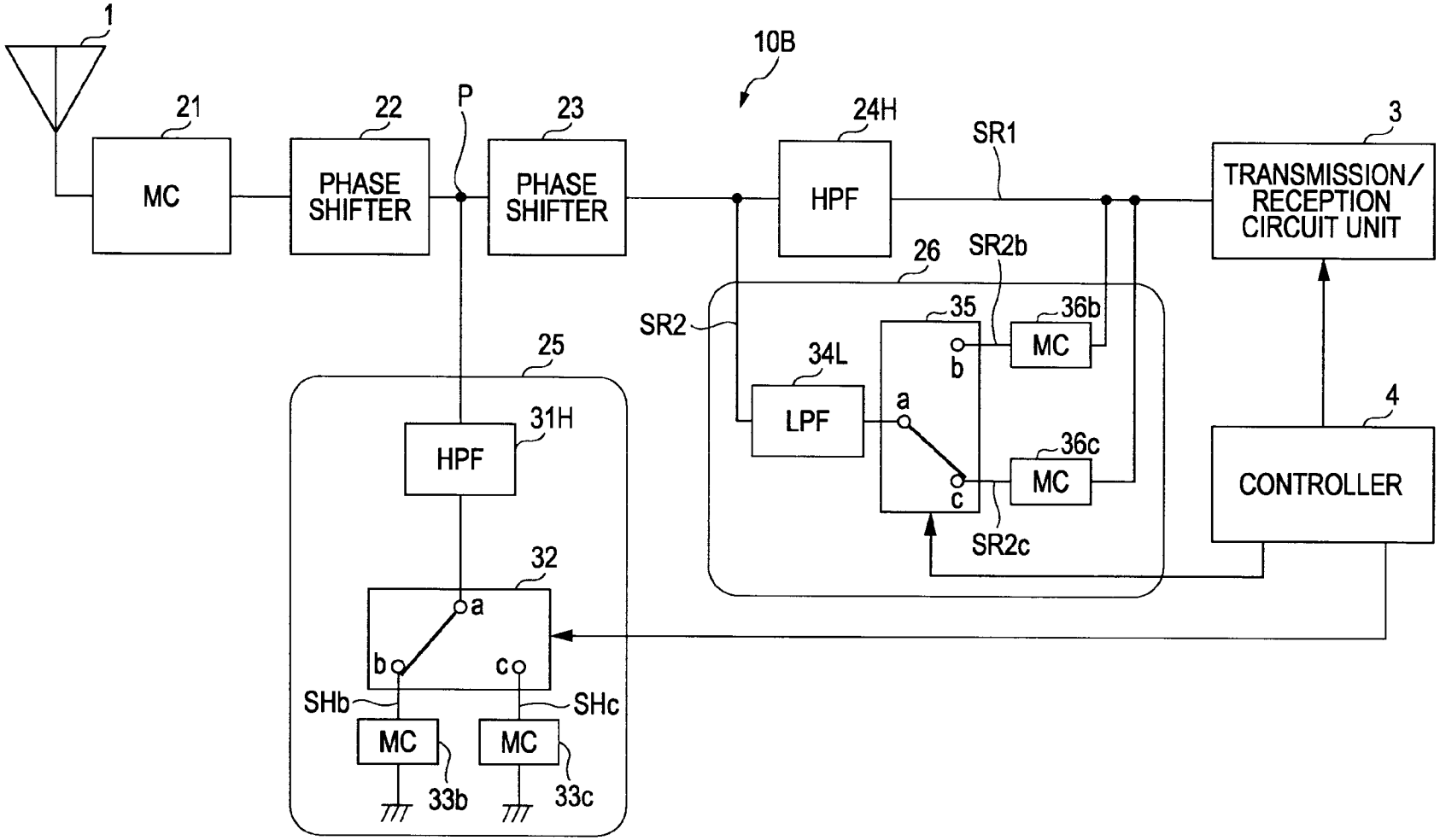
FIG. 13 is a block diagram showing a schematic configuration of an antenna device according to a second embodiment of the present invention.

FIG. 13 illustrates an example of the configuration of an antenna device 10B according to a second embodiment. In this configuration, a shunt high-pass filter 31H is provided in the shunt circuit 25, a series high-pass filter 24H is provided on the first series path SR1, and a series low-pass filter 34L is provided on the second series path SR2. In the configuration shown in FIG. 13, elements that are substantially the same as those in FIG. 2 are denoted by the same reference numerals as those in FIG. 2. In the second embodiment shown in FIG. 13, the first band B1 is a high band HB and the second band B2 is a low band LB.

A description below will be given of frequency ranges used by the antenna device 10B according to the second embodiment and matching constants of matching circuits. For simplicity of description, it is assumed that the phase adjustment values of the first phase shifter 22 and the second phase shifter 23 are pre-adjusted to optimum phase values.

In the antenna device 10B shown in FIG. 13, the series high-pass filter 24H allows passage of the high band HB and blocks a frequency range lower than the high band HB. Similarly, the shunt high-pass filter 31H allows passage of the high band HB and blocks a frequency range lower than the high band HB. A series low-pass filter 34L allows passage of the low band LB and blocks a frequency range higher than the low band LB.

In the antenna device 10B according to the second embodiment shown in FIG. 13, the shunt circuit 25 is provided as a matching circuit for the high band HB.

The first shunt matching circuit 33*b* in the shunt circuit 25 serves as a termination circuit for causing the impedance of the shunt circuit 25, viewed from the connection point P, to be substantially open, as in the case of the first embodiment.

The main matching circuit 21 has a matching constant adjusted such that impedance matching is achieved with respect to, for example, the first high band HB1 when the impedance of the shunt circuit 25 is open. That is, the matching constant of the main matching circuit 21 in the second embodiment is adjusted so as to satisfy the first high band HB1 when the shunt switch 32 selects the first switching shunt path SHb for the first shunt matching circuit 33*b*.

The second shunt matching circuit 33*c* in the shunt circuit 25 has a matching constant adjusted such that impedance matching is achieved with respect to the second high band HB2 through mutual cooperation with the impedance matching performed by the main matching circuit 21. That is, the matching constant of the second shunt matching circuit 33*c* in the second embodiment is adjusted such that, when the second switching shunt path SHc is selected, the impedance matching is achieved by the main matching circuit 21 and the second high band HB2 is satisfied.

In addition, in the antenna device 10B according to the present embodiment, the series circuit 26 is used as a matching circuit for the low band LB.

The matching constants of the first and second series matching circuits 36*b* and 36*c* in the series circuit 26 in the second embodiment are adjusted so as to satisfy all the frequency ranges of the low band LB when the first and second series matching circuits 36*b* and 36*c* are in the respective impedance states.

In particular, in the present embodiment, the matching constant of the first series matching circuit 36*b* is adjusted such that the first low band LB1 is satisfied when the impedance of the shunt switch 25 is substantially open.

In addition, in the present embodiment, the matching constant of the second series matching circuit 36*c* is adjusted such that the second low band LB2 is satisfied when the impedance of the shunt switch 25 is substantially open.

In the second embodiment, the controller 4 outputs, to the shunt switch 32, a switch operation control signal for selecting the first switching shunt path SHb when the first high band HB1 is used and outputs, to the shunt switch 32, a switch operation control signal for selecting the second switching shunt path SHc when the second high band HB2 is used.

When the first high band HB1 or the second high band HB2 is used, the controller 4 fixes the connection in the series switch 35 to one of the switched terminals.

On the other hand, when the first low band LB1 is used, the controller 4 outputs, to the shunt switch 32, a switch operation control signal for selecting the first switching shunt path SHb and outputs, to the series switch 35, a switch operation control signal for selecting the first switching series path SR2*b*. When the second low band LB2 is used, the controller 4 outputs, to the shunt switch 32, a switch operation control signal for selecting the first switching shunt path SHb and outputs, to the series switch 35, a switch operation control signal for selecting the second switching series path SR2*c*.

Similarly to the antenna device 10A according to the first embodiment described above, the second antenna device 10B according to the second embodiment shown in FIG. 13 can achieve optimum impedance matching for both the high band HB and the low band LB, thus making it possible to perform favorable communication.

[Third Embodiment]

Figure 14:
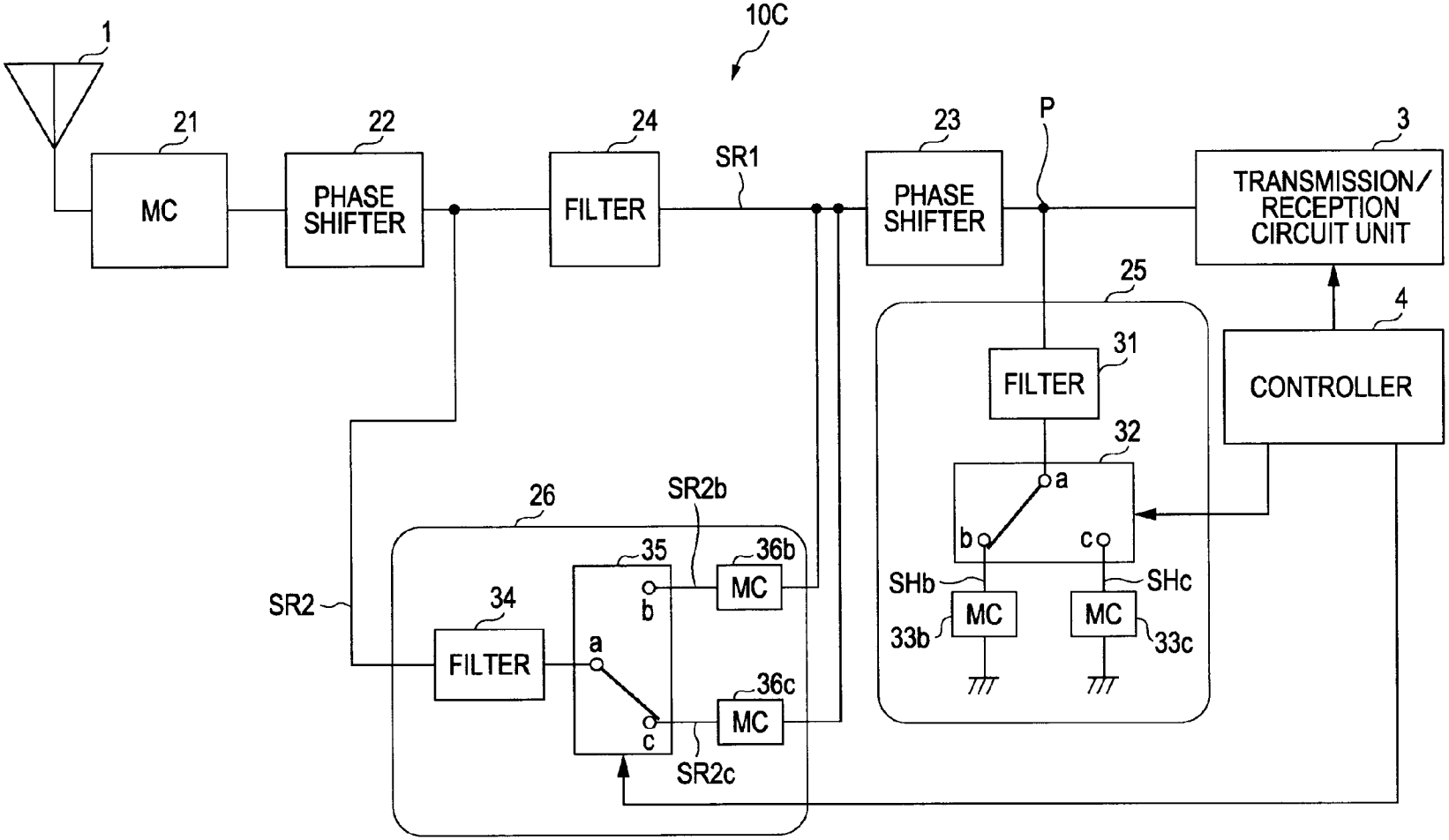
FIG. 14 is a block diagram showing a schematic configuration of an antenna device according to a third embodiment of the present invention.

FIG. 14 illustrates an example of the configuration of an antenna device 10C according to a third embodiment. In this configuration, the shunt circuit 25 is provided closer to the transmission/reception circuit unit 3 than the series circuit 26. In the configuration shown in FIG. 14, elements that are substantially the same as those in FIG. 1 are denoted by the same reference numerals as those in FIG. 1.

In the antenna device 10C shown in FIG. 14, the first series filter 24 is provided between the first phase shifter 22 and the second phase shifter 23 and the second phase shifter 23 is connected to the transmission/reception circuit unit 3.

The shunt circuit 25 in the antenna device 10C shown in FIG. 14 is connected to a connection point P between the second phase shifter 23 and the transmission/reception circuit unit 3. The shunt circuit 25 has a configuration that is similar to the configuration of the shunt circuit 25 in the antenna device 10 according to the embodiment described above. In the case of the antenna device 10C shown in FIG. 14, however, an input end of the shunt filter 31 is connected to the connection point P between the second phase shifter 23 and the transmission/reception circuit unit 3.

The series circuit 26 is also provided in parallel with the first series filter 24 and is connected between a connection point of the first phase shifter 22 and the first series filter 24 and a connection point of the first series filter 24 and the second phase shifter 23. The series circuit 26 has a configuration that is similar to the configuration of the series circuit 26 in the antenna device 10 according to the above-described embodiment. In the case of the antenna device 10C shown in FIG. 14, however, an input end of the second series filter 34 is connected to the connection point between the first phase shifter 22 and the first series filter 24. The switched terminal b of the series switch 35 is connected to the connection point of the first series filter 24 and the second phase shifter 23 via the first series matching circuit 36*b*. The switched terminal c of the series switch 35 is connected to the connection point of the first series filter 24 and the second phase shifter 23 via the second series matching circuit 36*c*.

In the third embodiment, each of the first series filter 24, the second series filter 34, and the shunt filter 31 may be implemented by a high-pass filter or a low-pass filter, as in the first and second embodiments described above.

Similarly to the antenna devices according to the first and second embodiments described above, the third antenna device 10C according to the third embodiment shown in FIG. 14 can achieve optimum impedance matching for both of the high band HB and the low band LB, thus making it possible to perform favorable communication.

[Fourth Embodiment]

Figure 15:
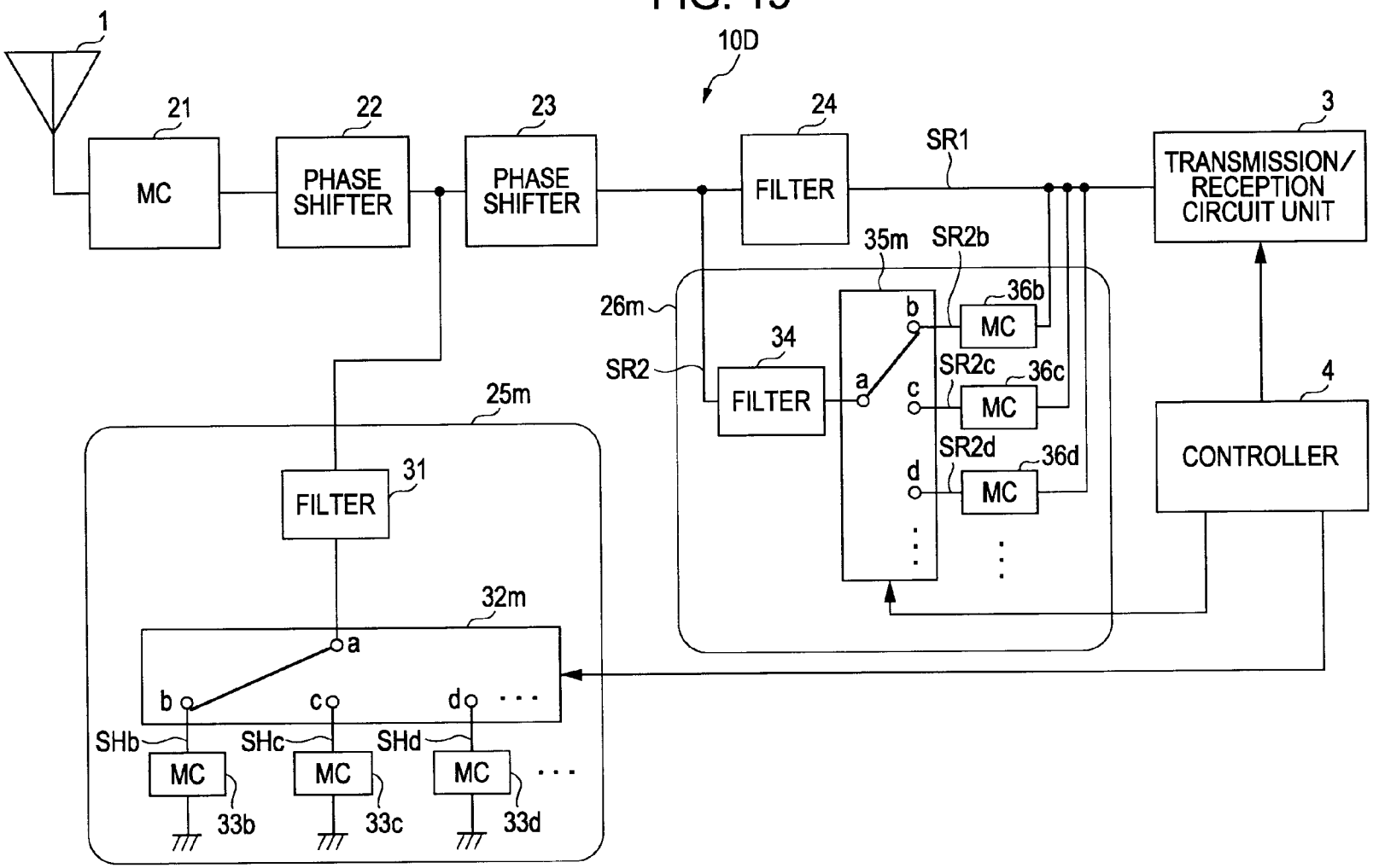
FIG. 15 is a block diagram showing a schematic configuration of an antenna device according to a fourth embodiment of the present invention.

FIG. 15 illustrates an example of the configuration of an antenna device 10D according to a fourth embodiment. The antenna device 10D according to the fourth embodiment is capable of handling a larger number of bands than the number of bands in each of the first and second embodiments described above. In the configuration shown in FIG. 15, elements that are substantially the same as those described above are denoted by the same reference numerals. It is assumed in a description below that the phase adjustment values of the first phase shifter 22 and the second phase shifter 23 are pre-adjusted to optimum phase values.

That is, in the antenna device 10D according to the present embodiment, the first band B1 is constituted by three or more bands and the second band B2 is also constituted by three or more bands. Thus, in the antenna device 10D according to the present embodiment shown in FIG. 15, a shunt circuit 25*m* has three or more shunt matching circuits 33*b*, 33*c*, 33*d*, . . . and a shunt switch 32*m* has multiple switched terminals b, c, d, . . . corresponding to shunt matching circuits. In the antenna device 10D according to the fourth embodiment, a series circuit 26*m* has three or more series matching circuits 36*b*, 36*c*, 36*d*, . . . and a series switch 35*m* has multiple switched terminals b, c, d, . . . corresponding to the series matching circuits.

In the antenna device 10D according to the fourth embodiment shown in FIG. 15, the first shunt matching circuit 33*b* in the shunt circuit 25*m* serves as a termination circuit for causing the impedance of the shunt circuit 25*m*, viewed from the connection point P of the main path, to be substantially open, as in the case described above.

The main matching circuit 21 has such a matching constant that impedance matching is achieved with respect to a predetermined band in the first band B1 when the impedance of the shunt circuit 25*m* is open. That is, the matching constant of the main matching circuit 21 is adjusted so as to satisfy a predetermined band in the first band B1 when the shunt switch 32*m* selects the first switching shunt path SHb for the first shunt matching circuit 33*b*. One example of the predetermined band is the above-described first low band LB1, for example, when the shunt circuit 25*m* is used for the low band LB.

The second shunt matching circuit 33*c*, the third shunt matching circuit 33*d*, . . . in the shunt circuit 25*m* have respective matching constants adjusted such that impedance matching is achieved with respect to the remaining bands included in the first band B1 through mutual cooperation with the impedance matching performed by the main matching circuit 21.

The matching constants of the series matching circuits 36*b*, 36*c*, 36*d*, . . . in the series circuit 26*m* in the antenna device 10D according to the present embodiment are adjusted so as to satisfy all the frequency ranges of the second band B2 when the series matching circuits 36*b*, 36*c*, 36*d*, . . . are in the respective impedance states. That is, the matching constants of the series matching circuits 36*b*, 36*c*, 36*d*, . . . in the series circuit 26*m* are adjusted so as to satisfy the corresponding bands of the second band B2 when the impedance of the shunt circuit 25*m* is substantially open.

In the fourth embodiment, when a predetermined band in the first band B1 is used, the controller 4 outputs, to the shunt switch 32*m*, a switch operation control signal for selecting the first switching shunt path SHb. When each of the remaining bands included in the first band B1 is used, the controller 4 outputs, to the shunt switch 32*m*, a switch operation control signal for selecting one of the switching shunt paths SHc, SHd, . . . corresponding to the band. When the first band B1 is used, the controller 4 fixes the connection in the series switch 35*m* to one of the switched terminals.

When the second band B2 is used, the controller 4 outputs, to the shunt switch 32*m*, a switch operation control signal for selecting the first switching shunt path SHb and outputs, to the series switch 35*m*, a switch operation control signal for selecting one of the switching series path SR2*b*, SR2*c*, SR2*d*, . . . corresponding to a desired band in the second band B2.

The antenna device 10D according to the fourth embodiment shown in FIG. 15 can achieve optimum impedance matching with respect to a larger number of bands than the number of bands in each of the above-described embodiments and can perform favorable communication.

In the fourth embodiment, each of the first series filter 24, the second series filter 34, and the shunt filter 31 may be implemented by a high-pass filter or a low-pass filter, as in the embodiments described above. In the fourth embodiment, the arrangement of the shunt circuit 25*m* and the series circuit 26*m* may also be modified as in the third embodiment described above.

[Fifth Embodiment]

Figure 16:
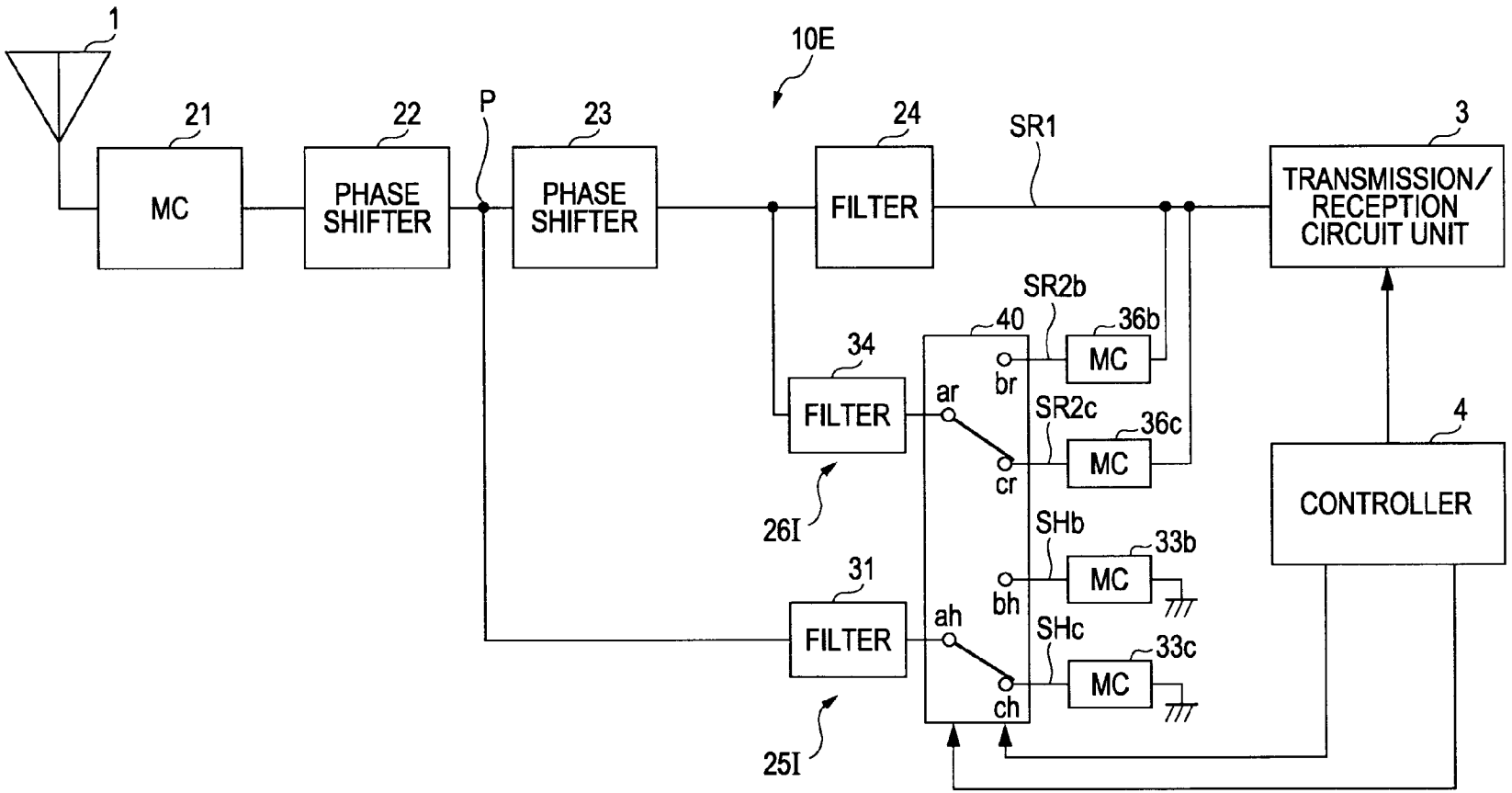
FIG. 16 is a block diagram showing a schematic configuration of an antenna device according to a fifth embodiment of the present invention.

FIG. 16 illustrates an example of the configuration of an antenna device 10E according to a fifth embodiment of the present embodiment. In the antenna device 10E, a shunt switch and a series switch are packaged into an integrated switch 40. In the configuration shown in FIG. 16, elements that are substantially the same as those described above are denoted by the same reference numerals. It is assumed in a description below that the phase adjustment values of the first phase shifter 22 and the second phase shifter 23 are pre-adjusted to optimum phase values.

In the antenna device 10E shown in FIG. 16, the integrated switch 40 has a common terminal ah for the shunt path, two switched terminals bh and ch, a common terminal ar for the series path, and two switched terminals br and cr.

The shunt-path common terminal ah in the integrated switch 40 is connected to an output end of the shunt filter 31 in a shunt circuit 25I. The shunt-path switched terminal bh in the integrated switch 40 is connected to the first shunt matching circuit 33*b* and the shunt-path switched terminal ch is connected to the second shunt matching circuit 33*c*.

On the other hand, the series-path common terminal ar in the integrated switch 40 is connected to an output end of the second series filter 34 in a series circuit 26I. The series-path switched terminal br in the integrated switch 40 is connected to the first series matching circuit 36*b* and the series-path switched terminal cr is connected to the second series matching circuit 36*c*.

In the fifth embodiment, for example, when the first switching shunt path SHb is used for use of the first band B1, the controller 4 outputs, to the integrated switch 40, a switch operation control signal for selecting the shunt-path switched terminal bh. When the second switching shunt path SHc is used for use of the first band B1, the controller 4 outputs, to the integrated switch 40, a switch operation control signal for selecting the shunt-path switched terminal ch. In this case, with respect to the series-path switched terminal br and cr, the controller 4 fixes the connection to one of the series-path switched terminal br and cr.

On the other hand, when the first switching series path SR2*b* is used for use of the second band B2, the controller 4 outputs, to the integrated switch 40, a switch operation control signal for selecting the shunt-path switched terminal bh and also outputs, to the integrated switch 40, a switch operation control signal for selecting the series-path switched terminal br corresponding to the first switching series path SR2*b*. On the other hand, when the second switching series path SR2*c* is used for use of the second band B2, the controller 4 outputs, to the integrated switch 40, a switch operation control signal for selecting the shunt-path switched terminal bh and also outputs, to the integrated switch 40, a switch operation control signal for selecting the series-path switched terminal cr corresponding to the second switching series path SR2*c*.

In the fifth embodiment, each of the first series filter 24, the second series filter 34, and the shunt filter 31 may be implemented by a high-pass filter or a low-pass filter, as in the first and second embodiments described above. In the fifth embodiment, the arrangement may also be such that a larger number of bands can be handled as in the case in the fourth embodiment described above. When the number of bands is increased as in the fourth embodiment, the number of shunt-path switched terminals and the number of series-path switched terminals in the integrated switch 40 are increased according to the increased number of bands and the controller 4 in such a case outputs a switch operation control signal for selecting one of the switched terminals. In the fifth embodiment, the arrangement of the shunt circuit 25*m* and the series circuit 26*m* may also be modified as in the case described above.

Similarly to the antenna device according to each of the above-described embodiments, the antenna device 10E according to the fifth embodiment shown in FIG. 16 can achieve optimum impedance matching with respect to each band and can perform favorable communication.

In the case of the antenna device 10E according to the fifth embodiment, since the multiple switch functions are incorporated into one integrated switch, it is possible to miniaturize the circuitry.

[Sixth Embodiment]

Figure 17:
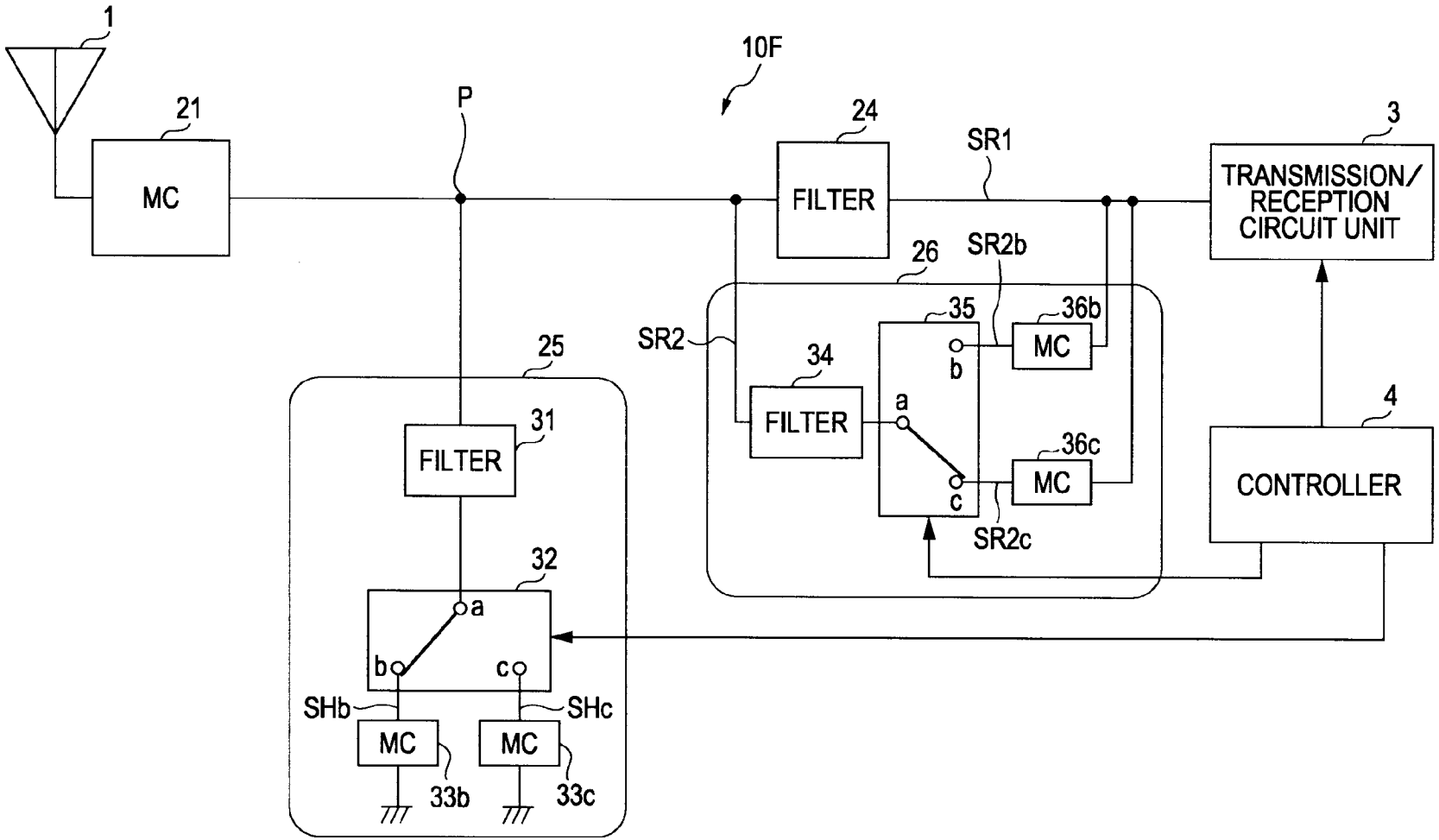
FIG. 17 is a block diagram showing a schematic configuration of an antenna device according to a sixth embodiment of the present invention.

FIG. 17 shows an example of the configuration of an antenna device 10F according to a sixth embodiment of the present invention. The antenna device 10F has no phase shifter. In the configuration shown in FIG. 17, elements that are substantially the same as those described above are denoted by the same reference numerals.

That is, there are cases in which phase adjustment does not have to be performed depending on the usage state and the shape of the radio communication apparatus, the type of antenna, the length of the signal line, and so on, and thus the antenna device 10F according to the sixth embodiment of the present invention is one example of the configuration in such a case in which the phase adjustment does not have to be performed.

In the antenna device 10F shown in FIG. 17, the antenna 1 is connected to the transmission/reception circuit unit 3 through the main matching circuit 21 and the first series filter 24, which are sequentially connected in series.

The shunt circuit 25 in the antenna device 10F shown in FIG. 17 is connected to a connection point P between the main matching circuit 21 and the first series filter 24.

The series circuit 26 is also provided in parallel with the first series filter 24 and is connected between a connection point of the main matching circuit 21 and the first series filter 24 and a connection point of the first series filter 24 and the transmission/reception circuit unit 3.

In the sixth embodiment, each of the first series filter 24, the second series filter 34, and the shunt filter 31 may be implemented by a high-pass filter or a low-pass filter, as in the first and second embodiments described above. In the sixth embodiment, the arrangement of the shunt circuit 25 and the series circuit 26 may also be modified as in the third embodiment described above. In the sixth embodiment, the arrangement may also be such that a larger number of bands are handled as in the case of the fourth embodiment described above. In addition, the antenna device 10F according to the sixth embodiment may also have a configuration using an integrated switch, as in the fifth embodiment described above.

Similarly to the antenna device according to each of the above-described embodiments, the antenna device 10F according to the sixth embodiment shown in FIG. 17 can achieve optimum impedance matching with respect to each band and can perform favorable communication.

Since the antenna device 10F according to the sixth embodiment has no phase shifter, it is possible to miniaturize the circuitry and to reduce the cost.

[Specific Circuit Configuration]

Figure 18:
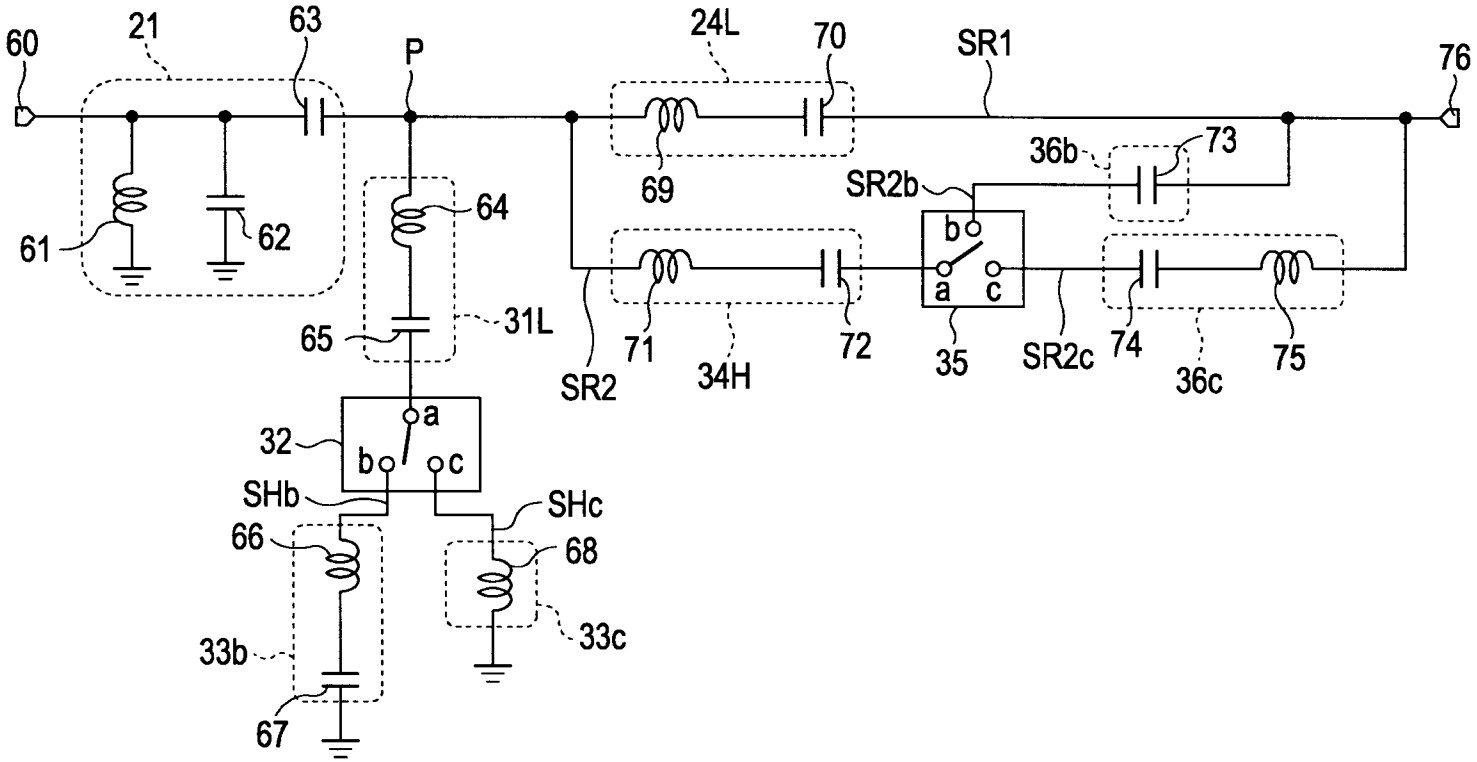
FIG. 18 is a circuit diagram showing a schematic circuit configuration of an antenna device according to an embodiment of the present invention.

FIG. 18 shows a specific circuit configuration of the antenna device 10 according to the embodiment of the present invention. In the configuration shown in FIG. 18, elements that are substantially the same as those described above are denoted by the same reference numerals. Although a phase shifter is omitted in the circuit configuration shown in FIG. 18, it is naturally desirable to provide a phase shifter.

FIG. 18 shows an example of a circuit configuration in which the first band B1 is the low band LB, the second band B2 is the high band HB, the first series filter 24 is the series low-pass filter 24L, the second series filter 34 is the series high-pass filter 34H, and the shunt filter 31 is the shunt low-pass filter 31L.

In the circuit configuration shown in FIG. 18, a terminal 60 is an antenna port connected to the antenna 1 and a terminal 76 is an RF port connected to the RF circuit of the transmission/reception circuit unit 3.

The main matching circuit 21 includes an inductor 61 and a capacitor 62, which are connected in parallel, and a capacitor 63. One end of the capacitor 63 is located adjacent to the terminal 60 and another end of the capacitor 63 is located adjacent to the terminal 76, and the capacitor 63 is connected in series with a main path connecting the terminal 60 and the terminal 76. One end of the inductor 61 and one end of the capacitor 62 are connected to ground and another end of the inductor 61 and another end of the capacitor 62 are connected between the terminal 60 and the capacitor 63.

The shunt low-pass filter 31L is constituted by an inductor 64 and a capacitor 65, which are connected in series, and becomes high impedance with respect to the high band HB. One end of the inductor 64 of the shunt low-pass filter 31L is connected to the connection point P and another end of the inductor 64 is connected to one end of the capacitor 65. Another end of the capacitor 65 is connected to the common terminal a of the shunt switch 32.

The first shunt matching circuit 33*b* is constituted by an inductor 66 and a capacitor 67, which are connected in series. One end of the inductor 66 of the first shunt matching circuit 33*b* is connected to the switched terminal b of the shunt switch 32 and another end of the inductor 66 is connected to one end of the capacitor 67. Another end of the capacitor 67 is connected to ground. A path that goes through the first shunt matching circuit 33*b* serves as the first switching shunt path SHb.

The second shunt matching circuit 33*c* is implemented by an inductor 68. One end of the inductor 68 is connected to the switched terminal c of the shunt switch 32 and another end of the inductor 68 is connected to ground. A path that goes through the second shunt matching circuit 33*c* serves as the second switching shunt path SHc.

The series low-pass filter 24L allows passage of only the low band LB and is constituted by an inductor 69 and a capacitor 70, which are connected in series with the main path. One end of the inductor 69 is connected to the capacitor 63 of the main matching circuit 21 via the connection point P and another end of the inductor 69 is connected to one end of the capacitor 70. Another end of the capacitor 70 is connected to the terminal 76. The path that goes through the series low-pass filter 24L corresponds to the first series path SR1.

The series low-pass filter 34H allows passage of only the high band HB and is constituted by an inductor 71 and a capacitor 72, which are connected in series. One end of the inductor 71 is connected to the capacitor 63 of the main matching circuit 21 via the connection point P and another end of the inductor 71 is connected to one end of the capacitor 72. Another end of the capacitor 72 is connected to the common terminal a of the series switch 35. The path that goes through the series high-pass filter 34H corresponds to the second series path SR2.

The first series matching circuit 36*b* is implemented by a capacitor 73. One end of the capacitor 73 is connected to the switched terminal b of the series switch 35 and another end of the capacitor 73 is connected to a connection point between the capacitor 70 of the series low-pass filter 24L and the terminal 76. A path that goes through the first series matching circuit 36*b* corresponds to the first switching series path SR2*b*.

The second series matching circuit 36*c* is constituted by a capacitor 74 and an inductor 75, which are connected in series. One end of the capacitor 74 is connected to the switched terminal c of the series switch 35 and another end of the capacitor 74 is connected to one end of the inductor 75. Another end of the inductor 75 is connected to a connection point between the capacitor 70 of the series low-pass filter 24L and the terminal 76. A path that goes through the second series matching circuit 36*c* corresponds to the second switching series path SR2*c*.

[Overall Configuration of Radio Communication Apparatus]

Figure 19:
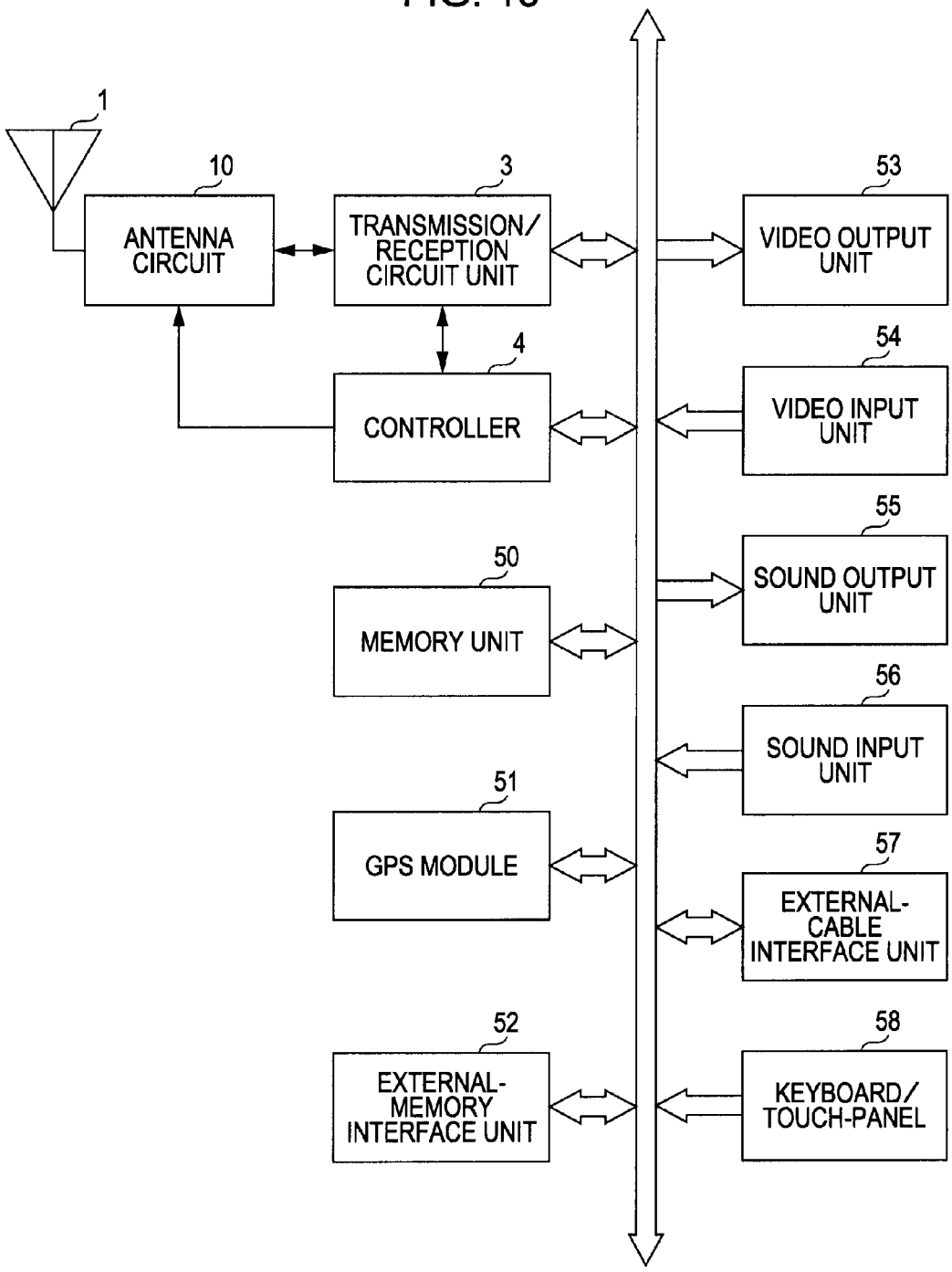
FIG. 19 is a block diagram showing a schematic configuration of a radio communication apparatus according to an embodiment of the present invention, the radio communication apparatus including the antenna device according to the embodiment of the present invention.

FIG. 19 shows an example of an overall configuration of a mobile radio terminal, which is one example of the radio communication apparatus according to an embodiment of the present invention, the radio communication apparatus including the antenna device 10 according to the embodiment of the present invention. The mobile radio terminal according to the present embodiment may be, for example, a mobile phone terminal. It goes without saying, however, that the present invention is not limited to the example.

In FIG. 19, an antenna 1 and an antenna circuit 10 correspond to the antenna device 10 according to the above-described embodiment of the present invention. A transmission/reception circuit unit 3 corresponds to the transmission/reception circuit unit 3 described in each of the above embodiments.

A video output unit 53 includes, for example, a liquid crystal display or an organic EL (electroluminescent) display and a display drive circuit for the display. In response to an image signal supplied from a controller 4, the display displays, for example, characters, a message, a still image, and a moving image.

A video input unit 54 includes, for example, an image-capture optical system and an image-capture element, such as a digital camera, and peripheral circuits and so on therefor.

A sound output unit 55 is, for example, a speaker. When the radio communication apparatus according to the present embodiment is a mobile phone terminal, the sound output unit 55 may be a speaker for call and a speaker for outputting a ringer (ring tone), alarm sound, playback music, playback moving image, and sound. The sound output unit 55 converts an audio signal, supplied from the controller 4, into an acoustic wave and outputs the acoustic wave into the air.

A sound input unit 56 is, for example, a microphone. When the radio communication apparatus according to the present embodiment is a mobile phone terminal, the sound input unit 56 may be a microphone for talk and for external sound collection. The sound input unit 56 converts an acoustic wave into an audio signal and sends the audio signal to the controller 4.

An external-cable interface (I/F) unit 57 includes, for example, a cable connector used for data communication through a cable and an interface circuit for external data communication. Data is exchanged via the external-cable interface unit 57 and is, for example, stored in a memory unit 50, as appropriate, under the control of the controller 4.

A keyboard/touch-panel 58 includes a keyboard having various buttons and keys, a touch panel or the like, and an operation-signal generating circuit for generating an operation signal upon operation of the keyboard or the touch panel. The touch panel may be provided on, for example, a substantially entire surface of the display of the video output unit 53. When the touch panel is provided on substantially the entire surface of the display, display positions on the screen of the display and touch detection positions on the touch panel are associated with each other. The radio communication apparatus according to the embodiment may have both the keyboard and the touch panel or may have one of them.

A GPS (global positioning system) module 51 has a GPS antenna and determines latitude and longitude of the current position of the mobile radio terminal by using GPS signals received from GPS satellites. GPS data (information indicating latitude and longitude) obtained by the GPS module 51 is sent to the controller 4. Thus, the controller 4 can recognize the current position of the mobile radio terminal.

An external-memory interface unit 52 includes, for example, a memory card connector and a memory-card interface circuit. A card-shaped external memory or the like for holding, for example, SIM (subscriber identify module) information or the like is attached to the memory card connector. The controller 4 writes/reads information to/from the external memory via the memory-card interface circuit. The memory card connector of the external-memory interface unit 52 may be a memory card connector to which a typical external memory card (except a SIM card) serving as an external storage medium is attached.

The memory unit 50 is a built-in memory and includes a ROM (read only memory) and a RAM (random access memory). The ROM stores an OS (operating system), a control program for causing the controller 4 to control the individual units, various initial setting values, dictionary data, sound data of ring tones, key operation sounds, and so on. The ROM also can store, for example, various application programs for SNS (social networking service), SMS (short message service/MMS (multimedia messaging service), electronic mail, music, moving pictures, and pictures, various types of content data handled by the application programs, and data of the above-described channel table. The ROM may be an overwritable ROM, such as a NAND-type flash memory or an EEPROM (electrically erasable programmable read-only memory). The overwritable ROM can store various types of data, such as content data, address data, schedule data, and image data, handled by various application programs. When the controller 4 performs various types of data processing, the RAM serves as a work area to store data.

The controller 4 has a CPU (central processing unit) and performs, for example, various types of control, such as the above-described control for the transmission/reception circuit unit 3, the above-described switching selection control for the antenna circuit 10, audio processing and control therefor, video processing and control therefor, various-signal processing, and control for the individual units. The controller 4 also executes various control programs and application programs stored in the memory unit 50 and information processing and so on of various types of content associated with the execution. In particular, in the present embodiment, the controller 4 can perform, for example, control for the transmission/reception circuit unit 3 as described above and switching control for the antenna circuit 10 on the basis of a frequency range and the radio system used in the communication system corresponding to the SIM card attached to the memory-card connector of the external-memory interface unit 52. In the present embodiment, on the basis of country or region information obtained by measurement of the GPS module 51, the controller 4 performs, for example, control for the transmission/reception circuit unit 3 and switching control for the antenna circuit 10 so as to correspond to the country or region.

The radio communication apparatus according to the present embodiment may further include a contactless communication unit for performing contactless communication via a contactless communication antenna, although such a configuration is not illustrated in FIG. 19. The contactless communication unit is used for, for example, an RFID (radio frequency identification) unit or a contactless IC (integrated circuit) card. The radio communication apparatus according to the present embodiment may also have a digital television receiver or the like. The radio communication apparatus may further have, for example, elements provided in a typical mobile phone terminal or the like. Examples include a battery for supplying power to the individual elements, a power management IC unit for controlling the power, a digital-broadcast receiving tuner unit, an AV (audio/video) codec unit, and a timer.

[Conclusion]

As described above, the antenna device 10 according to the present embodiment has a single antenna port connected to the antenna 1 and a single RF port connected to the RF circuit of the transmission/reception circuit unit 3. Since the number of antenna ports in the antenna device 10 according to the present embodiment is one, it is not necessarily to consider an influence of inter-coupling with another antenna.

In the antenna device 10 according to the embodiment, the series path is set for, for example, the second band B2 (e.g., the high band HB) and the shunt path is set for, for example, the first band B1 (e.g., the low band LB). Thus, for example, loss in the low band LB is significantly reduced compared to a case in which, for example, series paths are provided in both bands.

The antenna device 10 according to the present embodiment has the shunt circuit 25, which is capable of switching and selecting the multiple shunt paths having the respective matching circuits, and the series circuit 26, which is capable of switching and selecting the multiple series paths having the respective matching circuits. In addition, in the antenna device 10 according to the present embodiment, the filters for allowing passage of or blocking a signal in the first band B1 or the second band B2 are provided at corresponding stages prior to the shunt circuit 25 and the series circuit 26. According to the antenna device 10, the matching constants of the matching circuits in the shunt circuit 25 and the series circuit 26 are preset to have optimum values and, switching operation control with a simple configuration makes it possible to appropriate switching selection of the series path and the shunt path. In particular, the first band B1 is assigned to the shunt path, the second band B2 is assigned to the series path, an optimum matching constant for termination is set for one of the shunt paths, and optimum matching constants for the respective bands are set for other paths, so that the bands can be switched independently from each other. That is, in the antenna device 10 according to the present embodiment, a termination port is not necessary for the second band B2 even when the first band B1 is used and the path for the first band B1 is terminated when the second band B2 is used. In other words, according to the present embodiment, since one termination circuit is also used for matching, it is not necessary to provide two termination circuits for both of the first and second bands B1 and B2 and it is thus possible to miniaturize the configuration and to reduce the cost. For example, when the termination of the shunt circuit is not considered, the impedance of the shunt circuit affects the path switching of the series circuit to make it difficult to perform independent control/design. According to the configuration of the present embodiment, however, it is possible to perform the control and the design independently, for example, for the first band B1 and the second band B2.

As described above, the antenna device 10 according to the embodiment of the present invention makes it possible to easily set appropriate constants without using a large antenna and also makes it possible to achieve a high antenna efficiency and impedance matching for all multiple bands over a wide frequency range.

In addition, the antenna device 10 according to the embodiment of the present invention may have various configurations as the first to sixth embodiments described above.

The embodiments described above are merely examples of the present invention. Thus, the present invention is not limited to the embodiments described above, and needless to say, various changes and modifications can be made thereto depending on the design or the like without departing from the scope and spirit of the present invention.

Although the embodiments described above are aimed for a mobile phone terminal serving as a radio communication apparatus, the present invention is also applicable to various other radio communication apparatuses.

It should be understood by those skilled in the art that various modifications, combinations, sub-combinations and alterations may occur depending on design requirements and other factors insofar as they are within the scope of the appended claims or the equivalents thereof.

What is claimed is:

1. An antenna device comprising:

an antenna having a single feed;

a first phase shifter serially inserted in a main path connecting the antenna and a radio frequency circuit;

a first filter serially inserted in the main path and having an input end connected to an output end of the first phase shifter;

a second phase shifter serially inserted in the main path and having an input end connected to an output end of the first filter, wherein the first filter includes only a single output;

a first circuit including:

a second filter having an input end directly coupled to the output end of the first phase shifter on the main path;

a first single pole, dual throw (SPDT) switch having a common terminal, a first switched terminal, and a second switched terminal, wherein the common terminal is directly coupled to an output end of the second filter;

a first matching circuit having a first end directly coupled to the first switched terminal of the SPDT switch and a second end directly coupled to the main path between the output end of the first filter and an input end of the second phase shifter; and a second matching circuit having a first end directly coupled to the second switched terminal of the SPDT switch and a second end directly coupled to the main path between the output end of the first filter and the input end of the second phase shifter; and a selection controller configured to control the SPDT switch to selectively connect each of the first and second matching circuits in parallel to the main path.

2. The antenna device of claim 1, further comprising:

a second circuit including third and fourth matching circuits, wherein the second circuit is configured to selectively connect each of the third and fourth matching circuits in series with the main path.

3. The antenna device of claim 2, wherein the selection controller is configured to control selection of which of the third and fourth matching circuits are connected in series with the main path.

4. The antenna device of claim 2, further comprising:

a third filter provided at an output end of the second phase shifter between the main path and the second circuit.

5. A radio communication apparatus comprising:

an antenna device including:

an antenna having a single feed;

a first phase shifter serially inserted in a main path connecting the antenna and a radio frequency circuit;

a first filter serially inserted in the main path and having an input end connected to an output end of the first phase shifter;

a second phase shifter serially inserted in the main path and having an input end connected to an output end of the first filter, wherein the first filter includes only a single output;

a first circuit including:

a second filter having an input end directly coupled to the output end of the first phase shifter on the main path;

a single pole, dual throw (SPDT) switch having a common terminal, a first switched terminal, and a second switched terminal, wherein the common terminal is directly coupled to an output end of the second filter;

a first matching circuit having a first end directly coupled to the first switched terminal of the SPDT switch and a second end directly coupled to the main path between the output end of the first filter and an input end of the second phase shifter; and a second matching circuit having a first end directly coupled to the second switched terminal of the SP DT switch and a second end directly coupled to the main path between the output end of the first filter and the input end of the second phase shifter; and a selection controller configured to control the SPDT switch to selectively connect each of the first and second matching circuits in parallel to the main path.

6. The antenna device of claim 1, further comprising:

a second circuit including:

a third filter having an input end directly coupled to an output end of the second phase shifter on the main path;

a second single pole, dual throw (SPDT) switch having a common terminal, a first switched terminal, and a second switched terminal, wherein the common terminal is directly coupled to an output end of the third filter;

a third matching circuit having a first end directly coupled to the first switched terminal of the second SPDT switch and a second end directly coupled to ground; and a fourth matching circuit having a first end directly coupled to the second switched terminal of the second SPDT switch and a second end directly coupled to ground, wherein the selection controller is configured to control the second SPDT switch to selectively connect each of the third and fourth matching circuits in series to the main path.

* * * * *